US009478848B2

(12) United States Patent
Nagata

(10) Patent No.: US 9,478,848 B2
(45) Date of Patent: Oct. 25, 2016

(54) IN-VEHICLE SYSTEM

(71) Applicant: Tatsuki Nagata, Aichi (JP)

(72) Inventor: Tatsuki Nagata, Aichi (JP)

(73) Assignee: OMRON AUTOMOTIVE ELECTRONICS CO., LTD., Aichi (JP)

( * ) Notice: Subject to any disclaimer, the term of this patent is extended or adjusted under 35 U.S.C. 154(b) by 467 days.

(21) Appl. No.: 14/061,066

(22) Filed: Oct. 23, 2013

(65) Prior Publication Data

US 2014/0111391 A1 Apr. 24, 2014

(30) Foreign Application Priority Data

Oct. 23, 2012 (JP) ..... 2012-234021

(51) Int. Cl.
*H01Q 1/32* (2006.01)
*H01Q 21/28* (2006.01)

(52) U.S. Cl.
CPC ..... *H01Q 1/325* (2013.01); *H01Q 1/3241* (2013.01); *H01Q 1/3291* (2013.01); *H01Q 21/28* (2013.01)

(58) Field of Classification Search
USPC ..... 340/8.1
See application file for complete search history.

(56) References Cited

U.S. PATENT DOCUMENTS 7,181,189 B2 2/2007 Hotta et al.
7,915,998 B2 * 3/2011 Matsubara ..... G07C 9/00309 340/5.1
8,264,324 B2 * 9/2012 Tsuchiya ..... B60R 25/245 340/426.36
2005/0162259 A1 7/2005 Hotta et al.
2006/0186993 A1 * 8/2006 Inoue ..... B60R 25/245 340/5.72
2007/0109093 A1 5/2007 Matsubara et al.
2007/0162191 A1 * 7/2007 Matsubara ..... G07C 9/00309 701/1
2008/0258868 A1 10/2008 Nakajima et al.
2009/0289759 A1 11/2009 Tsuchiya et al.

FOREIGN PATENT DOCUMENTS

JP 2005105715 A 4/2005
JP 2005-207223 A 8/2005
JP 2006233533 A 9/2006
JP 2007-132139 A 5/2007
JP 2007-303254 A 11/2007
JP 2008-014019 A 1/2008
JP 2008266955 A 11/2008
JP 2009013697 A 1/2009
JP 2010285742 A 12/2010

OTHER PUBLICATIONS

Office Action issued in corresponding Japanese Application No. 2012-234021 dated Oct. 2, 2014, and English translation thereof (16 pages).

* cited by examiner

*Primary Examiner* — Mark Blouin
(74) *Attorney, Agent, or Firm* — Osha Liang LLP

(57) ABSTRACT

An in-vehicle system has a first transmitting antenna that is disposed in a substantial center in a front portion inside a vehicle, a second transmitting antenna that is disposed in the substantial center in a rear portion inside the vehicle, a third transmitting antenna that is disposed in a side surface near a driver seat or a passenger seat of the vehicle, a transmission controller that controls transmission of a first signal or a second signal from the first to third transmitting antennas, the second signal disturbing reception of the first signal, and a receiving antenna that receives a response signal, the response signal being transmitted from a portable device receiving the first signal transmitted from the first to third transmitting antennas.

16 Claims, 21 Drawing Sheets

FIG. 3

| TRANSMISSION PATTERN | (1) | (2) | (3) |
|---|---|---|---|
| TRANSMISSION AREA | 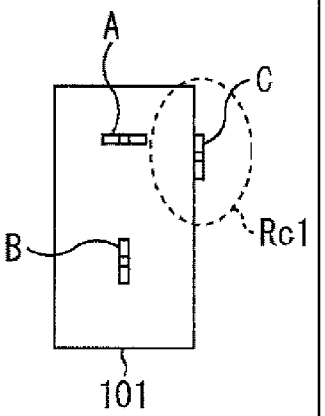  | 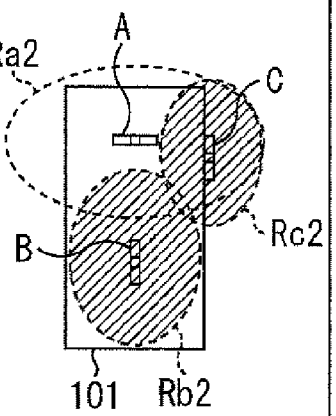  | 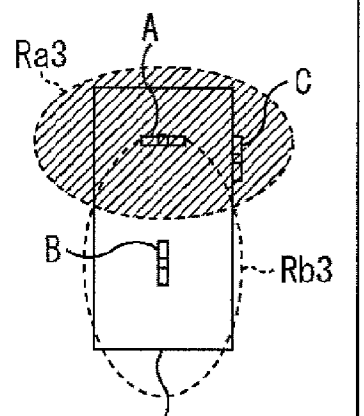  |
| TRANSMITTING SIGNAL: ANTENNA A | NO TRANSMISSION | NORMAL SIGNAL (LARGE INTENSITY) | DISTURBING SIGNAL (LARGE INTENSITY) |
| TRANSMITTING SIGNAL: ANTENNA B | NO TRANSMISSION | DISTURBING SIGNAL (SMALL INTENSITY) | NORMAL SIGNAL (LARGE INTENSITY) |
| TRANSMITTING SIGNAL: ANTENNA C | NORMAL SIGNAL (SMALL INTENSITY) | DISTURBING SIGNAL (SMALL INTENSITY) | NO TRANSMISSION |

FIG. 4
| TRANSMISSION PATTERN | (4) | (5) |
|---|---|---|
| TRANSMISSION AREA | 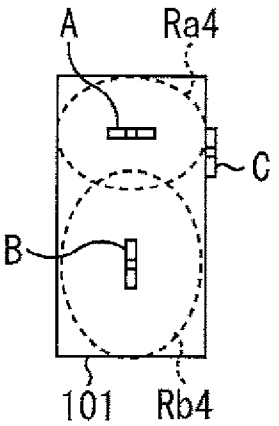  | 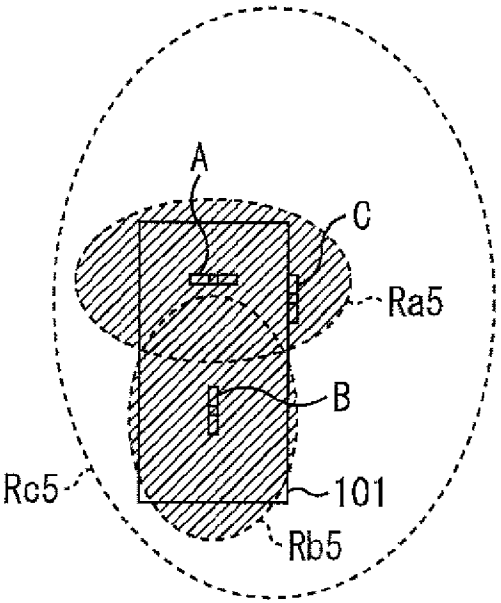  |
| TRANSMITTING SIGNAL / ANTENNA A | NORMAL SIGNAL (SMALL INTENSITY) | DISTURBING SIGNAL (LARGE INTENSITY) |
| TRANSMITTING SIGNAL / ANTENNA B | NORMAL SIGNAL (SMALL INTENSITY) | DISTURBING SIGNAL (LARGE INTENSITY) |
| TRANSMITTING SIGNAL / ANTENNA C | NO TRANSMISSION | NORMAL SIGNAL (LARGE INTENSITY) |

FIG. 11
| TRANSMISSION PATTERN | (6) | (7) |
|---|---|---|
| TRANSMISSION AREA | 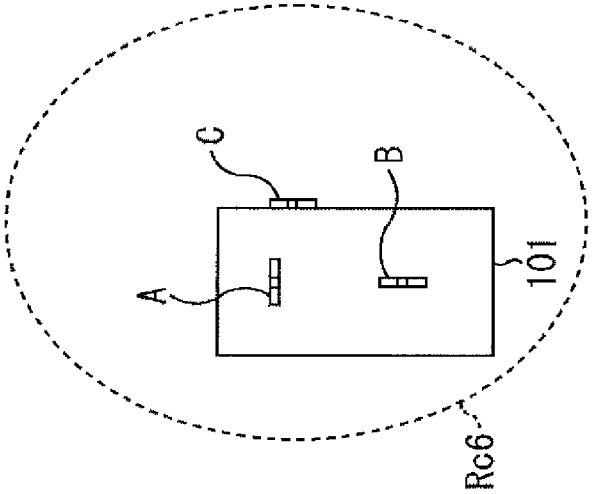  | 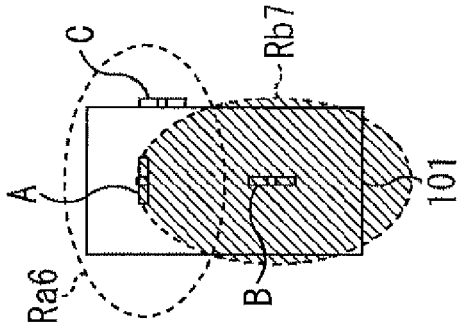  |
| TRANSMITTING SIGNAL | | |
| ANTENNA A | NO TRANSMISSION | NORMAL SIGNAL (LARGE INTENSITY) |
| ANTENNA B | NO TRANSMISSION | DISTURBING SIGNAL (LARGE INTENSITY) |
| ANTENNA C | NORMAL SIGNAL (LARGE INTENSITY) | NO TRANSMISSION |

FIG. 12

| CONDITION | IN THE CASE THAT OPERATING SWITCH OF DRIVER SEAT DOOR IS PRESSED | | | | IN THE CASE THAT OPERATING SWITCH OF PASSENGER SEAT DOOR IS PRESSED | | | |
|---|---|---|---|---|---|---|---|---|
| TRANSMISSION PATTERN | (6) | (7) | (2) | (4) | (6) | (7) | (2) | (4) |
| ANTENNA A | | | | | | | | |
| ANTENNA B | | | | | | | | |
| ANTENNA C | | | | | | | | |
| RECEPTION RESULT | ○ | ○ | × | × | ○ | ○ | ○ | × |
| DETERMINATION RESULT (PORTABLE DEVICE POSITION) | NEIGHBORHOOD (OUTSIDE VEHICLE) OF DRIVER SEAT DOOR | | | | NEIGHBORHOOD (OUTSIDE VEHICLE) OF PASSENGER SEAT DOOR | | | |

FIG. 15
| TRANSMISSION PATTERN | (8) | (9) |
|---|---|---|
| TRANSMISSION AREA | 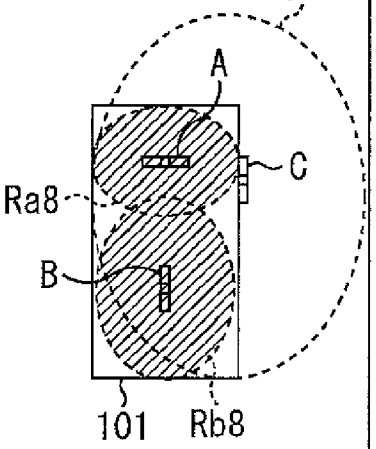  | 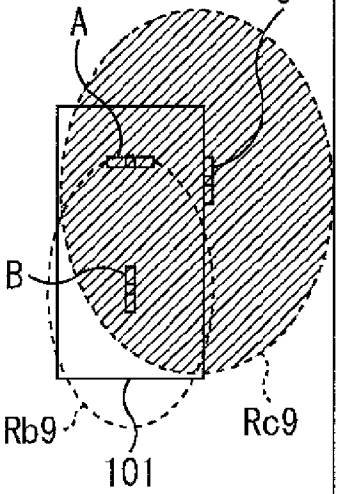  |
| TRANSMITTING SIGNAL / ANTENNA A | DISTURBING SIGNAL (SMALL INTENSITY) | NO TRANSMISSION |
| TRANSMITTING SIGNAL / ANTENNA B | DISTURBING SIGNAL (SMALL INTENSITY) | NORMAL SIGNAL (LARGE INTENSITY) |
| TRANSMITTING SIGNAL / ANTENNA C | NORMAL SIGNAL (MEDIUM INTENSITY) | DISTURBING SIGNAL (MEDIUM INTENSITY) |

IN-VEHICLE SYSTEM

TECHNICAL FIELD

The present invention relates to an in-vehicle system, particularly to an in-vehicle system that suitably operates a vehicle using a portable device.

RELATED ART

Nowadays, there is widely spread a vehicle on which a function such as a keyless entry or a passive entry is mounted. In the keyless entry or the passive entry, a door of the vehicle can be locked and unlocked using not a mechanical key but a portable device that conducts wireless communication with an ECU (Electronic Control Unit) mounted on the vehicle. Nowadays, there is also widely spread a vehicle on which an engine starting function is mounted. in the engine starting function, the ECU mounted on the vehicle and the portable device conduct wireless communication with each other, and an engine or a motor of the vehicle can be started when the regular portable device exists in the vehicle.

In order to implement these functions, it is necessary that an antenna is placed in the vehicle to detect a position of the portable device. Conventionally, there has been proposed a technology that accurately detects the position of the portable device while reducing the number of placed antennas.

For example, in a proposal disclosed in Japanese Unexamined Patent publication No. 2009-13697, a response request signal is transmitted to different areas using two indoor antennas and three outdoor antennas, and the position of the portable device is detected based on a reception result of a response signal from the portable device.

In a proposal disclosed in Japanese Unexamined Patent Publication No. 2008-266955, the portable device detects an intensity of a transmitting signal from the total of three transmitting antennas located in right and left side mirrors and a rear portion of the vehicle, and whether the portable device exists inside or outside the vehicle is determined based on the detection result.

In a proposal disclosed in Japanese Unexamined Patent Publication No. 2005-105715, the reception result of the signal in the portable device is detected while the transmission intensity of the signal from the total of three transmitting antennas located in right and left side surfaces near a gate lifter (back door) in the vehicle and the substantial center in the gate lifter is changed, and whether the portable device exists inside or outside the vehicle is determined in the neighborhood of the gate lifter.

In a proposal disclosed in Japanese Unexamined Patent Publication No. 2010-285742, whether the portable device exists inside or outside the vehicle is determined based on a reception intensity of the transmitting signal from the portable device through three antennas, which are separately disposed in the vehicle along a center line of the vehicle, and a previously-produced determination table.

In a technology proposed in Japanese Unexamined Patent Publication No. 2006-233533, detection accuracy of the position of the portable device is enhanced by limiting the area, where the portable device is detected, using a disturbing signal.

SUMMARY

One or more embodiments of the present invention accurately detects the position of the portable device in the neighborhood of the vehicle using three transmitting antennas. One or more embodiments of the present invention surely controls the vehicle according to the position of the portable device.

In accordance with one or more embodiments of the present invention, an in-vehicle system includes: a first transmitting antenna that is disposed in a substantial center in a front portion inside a vehicle; a second transmitting antenna that is disposed in the substantial center in a rear portion inside the vehicle; a third transmitting antenna that is disposed in a side surface near a driver seat or a passenger seat of the vehicle; a transmission controller that controls transmission of a first signal or a second signal from the first to third transmitting antennas, the second signal disturbing reception of the first signal; a receiving antenna that receives a response signal, the response signal being transmitted from a portable device receiving the first signal transmitted from the first to third transmitting antennas; and a position detector that detects a position of the portable device based on a transmission content of the signal from the first to third transmitting antennas and a reception result of the response signal from the portable device.

In the in-vehicle system according to one or more embodiments of the present invention, the first signal or the second signal disturbing the reception of the first signal is transmitted from the first transmitting antenna disposed in the substantial center in the front portion inside the vehicle, the second transmitting antenna disposed in the substantial center in the rear portion inside the vehicle, and the third transmitting antenna disposed in the side surface near the driver seat or the passenger seat of the vehicle, and the position of the portable device is detected based on the transmission content of the signal from the first to third transmitting antennas and the reception result of the response signal from the portable device.

Accordingly, the position of the portable device can accurately be detected in the neighborhood of the vehicle using the three transmitting antennas.

The vehicle includes various body types such as a sedan, a hatchback, a coupe, a minivan, a wagon, and an SUV (Sport Utility Vehicle). For example, the first signal and the second signal are an LF-band signal. For example, the response signal is a UHF-band signal. For example, the transmission controller and the position detector is constructed by a processor such as a CPU.

In the in-vehicle system according to one or more embodiments of the present invention, the transmission controller may control existence or non-existence of the transmission of the first signal or the second signal from the first to third transmitting antennas and a transmission pattern that is a pattern of a transmission intensity, and the position detector may detect the position of the portable device based on the reception result of the response signal from the portable device in each transmission pattern when at least two transmission patterns are combined.

Therefore, the detailed position of the portable device can be detected in the neighborhood of the vehicle.

In the in-vehicle system according to one or more embodiments of the present invention, the first transmitting antenna may be disposed such that directivity of the first transmitting antenna is oriented in a crosswise direction of the vehicle.

Therefore, the area to which the first signal or the second signal is transmitted can mainly be adjusted in the crosswise direction in the front portion of the vehicle.

In the in-vehicle system according to one or more embodiments of the present invention, the second transmitting antenna may be disposed such that the directivity of the second transmitting antenna is oriented in a front-back direction of the vehicle.

Therefore, the area to which the first signal or the second signal is transmitted can mainly be adjusted in the front-back direction in the rear portion of the vehicle.

In the in-vehicle system according to one or more embodiments of the present invention, the second transmitting antenna may be disposed such that the directivity of the second transmitting antenna is oriented in the crosswise direction of the vehicle.

Therefore, the area to which the first signal or the second signal is transmitted can mainly be adjusted in the crosswise direction in the rear portion of the vehicle.

In the in-vehicle system according to one or more embodiments of the present invention, the third transmitting antenna may be disposed such that the directivity of the third transmitting antenna is oriented in the front-back direction of the vehicle.

Therefore, the area to which the first signal or the second signal is transmitted can mainly be adjusted in the front-back direction in the neighborhood of the driver seat or the passenger seat of the vehicle.

In the in-vehicle system according to one or more embodiments of the present invention, the third transmitting antenna may be disposed such that the directivity of the third transmitting antenna is oriented in an up-and-down direction of the vehicle.

Therefore, the area to which the first signal or the second signal is transmitted can be set to not an elliptical shape but a shape close to a precise circle in the neighborhood of the driver seat or the passenger seat of the vehicle.

In the in-vehicle system according to one or more embodiments of the present invention, the third transmitting antenna may be disposed in the side surface on a side of the driver seat of the vehicle.

Therefore, detection accuracy of the position of the portable device is improved in the neighborhood of the driver seat.

In the in-vehicle system according to one or more embodiments of the present invention, the transmission controller may perform control such that the first signal or the second signal is transmitted from the first transmitting antenna to a first area including the driver seat and the passenger seat in the vehicle or a second area inside and outside the vehicle, the second area including a neighborhood of a door of the driver seat and a neighborhood of a door of the passenger seat, the transmission controller may perform control such that the first signal or the second signal is transmitted from the second transmitting antenna to a third area including a rear seat and a luggage room in the vehicle or a fourth area inside and outside the vehicle, the fourth area including a neighborhood of an opening and closing body in the rear portion of the vehicle, and the transmission controller may perform control such that the first signal or the second signal is transmitted from the third transmitting antenna to a fifth area near the driver seat door inside and outside the vehicle.

Therefore, the portable device existing in the neighborhood of the driver seat door, in the neighborhood of the passenger seat door, in the neighborhood of the opening and closing body in the rear portion of the vehicle, or in the vehicle can accurately be detected.

For example, the luggage room is constructed by a luggage room in the rear portion in the vehicle or a trunk room. For example, the opening and closing body is constructed by a tailgate (back door) or a trunk lid.

In the in-vehicle system according to one or more embodiments of the present invention, the transmission controller may further perform control such that the first signal or the second signal is transmitted from the third transmitting antenna to a sixth area including the whole vehicle and a surrounding area of the vehicle.

Therefore, the portable device existing in the whole vehicle and in a predetermined range of a surrounding area of the vehicle.

In the in-vehicle system according to one or more embodiments of the present invention, the transmission controller may further perform control such that the first signal or the second signal is transmitted from the third transmitting antenna to a seventh area inside and outside the vehicle, the seventh area including a neighborhood of the side surface on the side of the driver seat and not including the side surface on the side of the passenger seat.

Therefore, the portable device existing near the side surface on the driver seat side of the vehicle.

In the in-vehicle system according to one or more embodiments of the present invention, the third transmitting antenna may be disposed in a side mirror or a door handles on the side of the driver seat.

Therefore, the space can effectively be used to provide the third transmitting antenna without degrading an appearance of the vehicle.

The in-vehicle system according to one or more embodiments of the present invention may further include a vehicle controller that controls the vehicle based on the detected position of the portable device.

Therefore, the vehicle can surely be controlled according to the position of the portable device.

For example, the vehicle controller is constructed by a processor such as a CPU.

In the in-vehicle system according to one or more embodiments of the present invention, the vehicle controller may control locking or unlocking of a door of the driver seat, a door of the passenger seat, or the opening and closing body in the rear portion of the vehicle based on whether the portable device exists near the door of the driver seat, the door of the passenger seat, or the opening and closing body outside the vehicle.

Therefore, the locking and the unlocking of the driver seat door, the passenger seat door, or the opening and closing body in the rear portion of the vehicle can surely be controlled.

In the in-vehicle system according to one or more embodiments of the present invention, the vehicle controller may control starting of the vehicle based on whether the portable device exists in the vehicle.

Therefore, the starting of the vehicle can surely be controlled.

In accordance with one or more embodiments of the present invention, an in-vehicle system includes: a first transmitting antenna that is disposed in a substantial center in a front portion inside a vehicle; a second transmitting antenna that is disposed in the substantial center in a rear portion inside the vehicle; a third transmitting antenna that is disposed in a side surface near a driver seat or a passenger seat of the vehicle; a transmission controller that controls transmission of a signal from the first to third transmitting antennas, and controls existence or non-existence of transmission of a first signal or a second signal from the first to third transmitting antennas and a transmission pattern that is a pattern of transmission intensity, the second signal disturbing reception of the first signal; a receiving antenna that receives a response signal, the response signal being transmitted from a portable device receiving the first signal transmitted from the first to third transmitting antennas; and a vehicle controller that controls the vehicle based on a reception result of the response signal from the portable device in each transmission pattern when at least two transmission patterns are combined.

In the in-vehicle system according to one or more embodiments of the present invention, the existence or non-existence of the transmission of the first signal or the second signal disturbing the reception of the first signal and the transmission pattern that is the pattern of the transmission intensity from the first transmitting antenna disposed in the substantial center in the front portion inside the vehicle, the second transmitting antenna disposed in the substantial center in the rear portion inside the vehicle, and the third transmitting antenna disposed in the side surface near the driver seat or the passenger seat of the vehicle, and the vehicle is controlled based on the reception result of the response signal from the portable device in each transmission pattern when at least the two transmission patterns are combined.

Accordingly, using the three transmitting antennas, the vehicle can surely be controlled according to the position of the portable device.

The vehicle includes various body types such as a sedan, a hatchback, a coupe, a minivan, a wagon, and an SUV (Sport Utility Vehicle). For example, the first signal and the second signal are an LF-band signal. For example, the response signal is a UHF-band signal. For example, the vehicle controller is constructed by a processor such as a CPU.

In accordance with one or more embodiments of the present invention, an in-vehicle system that detects a position of a portable device based on a reception result of a response signal from the portable device with respect to a signal transmitted from a transmitting antenna, the in-vehicle system includes: a first transmitting antenna that is disposed in a substantial center in a front portion inside a vehicle; a second transmitting antenna that is disposed in the substantial center in a rear portion inside the vehicle; a third transmitting antenna that is disposed in a side surface near a driver seat or a passenger seat of the vehicle; a receiving antenna that receives the response signal, the response signal being transmitted from the portable device receiving a predetermined signal transmitted from the first to third transmitting antennas; and a controller that controls transmission and reception of the signal at the first to third transmitting antennas and the receiving antenna.

In the in-vehicle system according to one or more embodiments of the present invention, a predetermined signal is transmitted from the first transmitting antenna disposed in the substantial center in the front portion inside the vehicle, the second transmitting antenna disposed in the substantial center in the rear portion inside the vehicle, and the third transmitting antenna disposed in the side surface near the driver seat or the passenger seat of the vehicle, and the response signal transmitted from the portable device that receives the predetermined signal is received.

Accordingly, the position of the portable device can accurately be detected in the neighborhood of the vehicle using the three transmitting antennas.

The vehicle includes various body types such as a sedan, a hatchback, a coupe, a minivan, a wagon, and an SUV (Sport Utility Vehicle). For example, the predetermined signal is an LF-band signal. For example, the response signal is a UHF-band signal. For example, the controller is constructed by a processor such as a CPU.

In one or more embodiments of the present invention, the position of the portable device can accurately be detected near the vehicle using the three transmitting antennas. In one or more embodiments of the present invention, the vehicle can surely be controlled according to the position of the portable device.

BRIEF DESCRIPTION OF THE DRAWINGS

FIG. 3 is a view illustrating an example of a transmission pattern;

FIG. 4 is a view illustrating an example of the transmission pattern;

FIG. 11 is a view illustrating another example of the transmission pattern;

FIG. 12 is a view illustrating a first modification of the combination of the transmission patterns;

FIG. 15 is a view illustrating still another example of the transmission pattern;

DETAILED DESCRIPTION

Hereinafter, embodiments of the present invention will be described. In embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid obscuring the invention. The description is made in the following sequence.

1. Embodiments
2. Modification

1. Embodiments (Configuration Example of Vehicle Control System)

Figure 1:
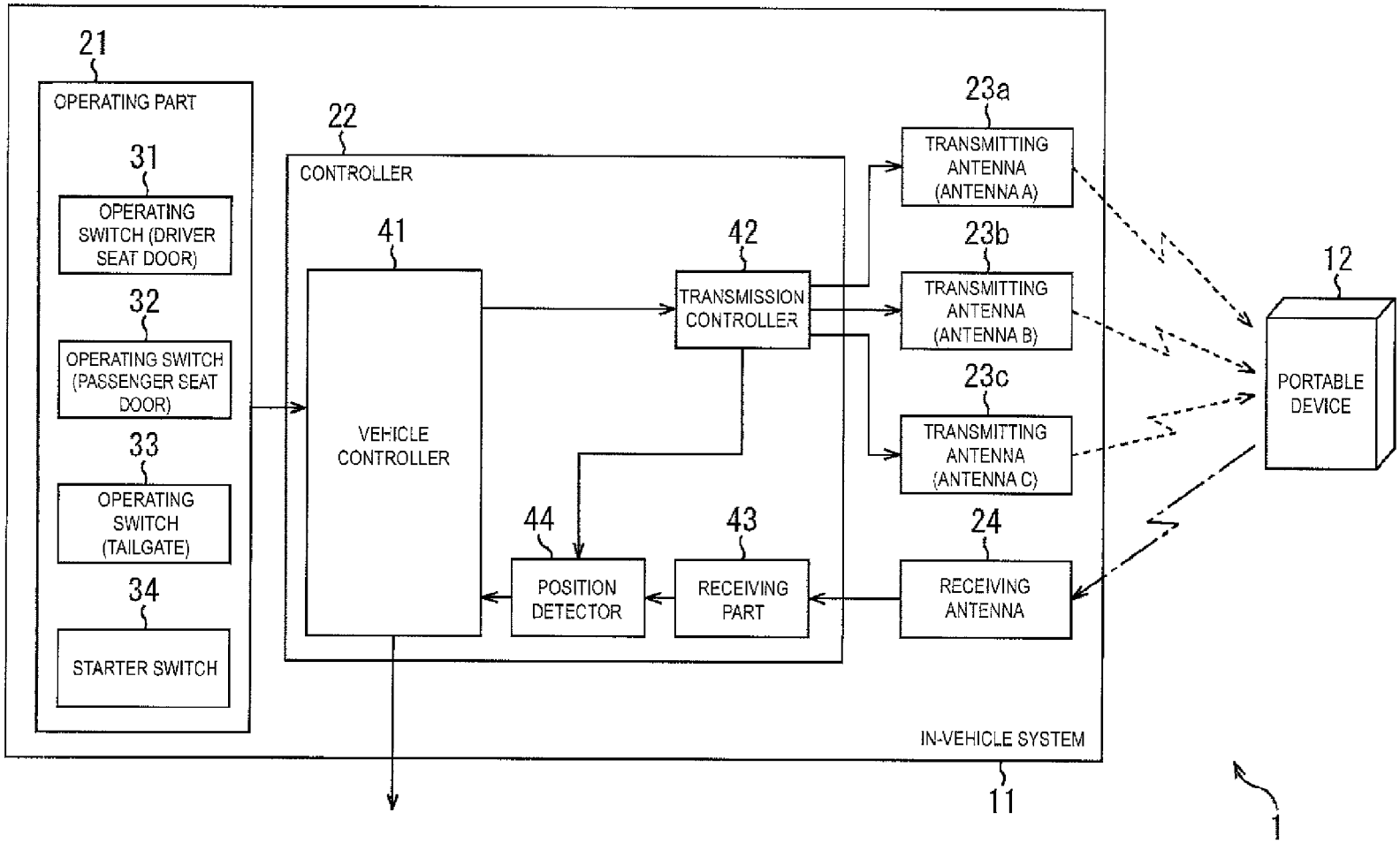
FIG. 1 is a block diagram illustrating a vehicle control system according to one or more embodiments of the present invention.
Figure 2:
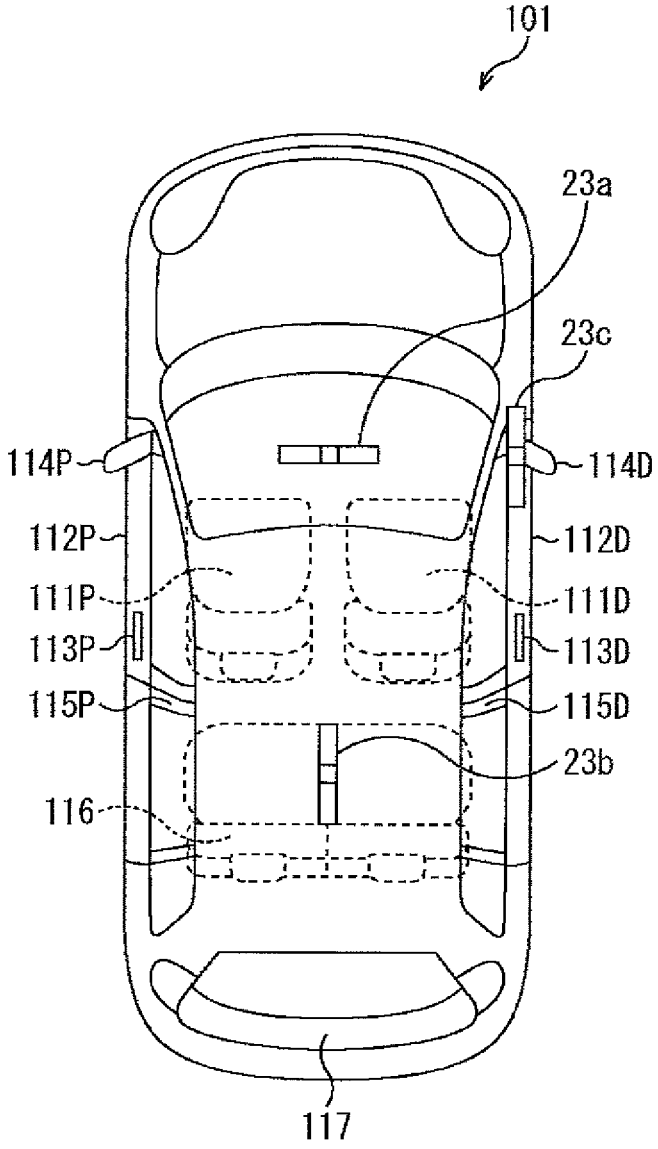
FIG. 2 is a schematic diagram illustrating an example of dispositions of transmitting antennas.

FIG. 1 is a block diagram illustrating a vehicle control system 1 according to one or more embodiments of the present invention. FIG. 2 is a schematic diagram illustrating an example of dispositions of transmitting antennas 23*a* to 23*c* of the vehicle control system 1.

The vehicle control system 1 includes an in-vehicle system 11 and a portable device 12.

The in-vehicle system 11 is provided in a vehicle 101, conducts wireless communication with the portable device 12 to detect a present position of the portable device 12, and controls the vehicle 101 based on a detection result. for example, the in-vehicle system 11 controls locking and unlocking of a door 112D (hereinafter referred to as a driver seat door 112D) of a driver seat 111D of the vehicle 101, a door 112P (hereinafter referred to as a passenger seat door 112P) of a passenger seat 111P, and a tailgate 117 that is of a rear opening and closing body of the vehicle 101. For example, the in-vehicle system 11 controls starting of the vehicle 101.

There is no particular limitation to a kind of the vehicle 101 in which the in-vehicle system 11 is provided. Desirably the kind of the vehicle 101 is a kind, such as a private automobile, in which a length in a front-back direction falls within a predetermined range. There is no particular limitation to a body type of the vehicle 101. The in-vehicle system 11 can be provided in various bodies types of vehicles such as a sedan, a hatchback, a coupe, a minivan, a wagon, and an SUV (Sport Utility Vehicle).

The in-vehicle system 11 includes an operating part 21, a controller 22, the transmitting antennas 23*a* to 23*c*, and a receiving antenna 24.

The operating part 21 includes operating switches 31 to 33 and a starter switch 34.

For example, the operating switch 31 is provided near a door handle 113D of the driver seat door 112D, and used to lock and unlock the driver seat door 112D. In the case that an operation is performed, the operating switch 31 supplies a signal indicating an operating content to a vehicle controller 41 of the controller 22.

For example, the operating switch 32 is provided near a door handle 113P of the passenger seat door 112P, and used to lock and unlock the passenger seat door 112P. In the case that the operation is performed, the operating switch 32 supplies the signal indicating the operating content to the vehicle controller 41 of the controller 22.

For example, the operating switch 33 is provided near a door handle (not illustrated) of the tailgate 117, and used to lock and unlock the tailgate 117. In the case that the operation is performed, the operating switch 33 supplies the signal indicating the operating content to the vehicle controller 41 of the controller 22.

Each of the operating switches 31 to 33 may be separated into locking and unlocking switches, or constructed by one common locking and unlocking switch. The operating switches 31 to 33 may be constructed by a sensor that detects that a user touches or holds the door handle.

For example, the starter switch 34 is provided near an operating panel (not illustrated) in front of the driver seat 111D in the vehicle 101, and used to start an engine or a motor of the vehicle 101. In the case that the operation is performed, the starter switch 34 supplies the signal indicating the operating content to the vehicle controller 41 of the controller 22.

For example, the controller 22 is constructed by a processor such as a CPU (Central Processing Unit), and includes the vehicle controller 41, a transmission controller 42, a receiving part 43, and a position detector 44.

The vehicle controller 41 notifies the transmission controller 42 of an operating content received from the operating part 21. The vehicle controller 41 controls the vehicle 101 based on the operating content input to the operating part 21 and the detection result of the position of the portable device 12 by the position detector 44. For example, the vehicle controller 41 control the locking and unlocking of the driver seat door 112D, the passenger seat door 112P, and the tailgate 117 and the starting of the vehicle 101.

The transmission controller 42 controls transmission of a response request signal and a disturbing signal from the transmitting antennas 23*a* to 23*c* to the portable device 12. More specifically, the transmission controller 42 controls the existence or non-existence of the transmission of the response request signal or disturbing signal from the transmitting antennas 23*a* to 23*c* and a transmission pattern that is a pattern of transmission intensity. The transmission controller 42 notifies the position detector 44 of the transmission pattern of the signal transmitted from the transmitting antennas 23*a* to 23*c*.

As used herein, the response request signal means a signal, which is transmitted to an area where the portable device 12 should be detected and requests a response from the portable device 12 existing in the area. When receiving the response request signal, the portable device 12 transmits a response signal according thereto. On the other hand, the disturbing signal means a signal, which is transmitted to an area excluded from the area where the portable device 12 should be detected and blocks the portable device 12 existing in the area from receiving and responding to the response request signal.

Hereinafter, the response request signal is also referred to as a normal signal with respect to the disturbing signal.

The receiving part 43 receives the response signal from the portable device 12 through the receiving antenna 24, and notifies the position detector 44 of the received response signal.

The position detector 44 authenticates authentication information included in the response signal. The position detector 44 detects the transmission content of the signal from the transmitting antennas 23*a* to 23*c*, and detects the position of the portable device 12 based on a reception result of the response signal from the portable device 12. That is, the position detector 44 detects the position of the portable device 12 based on the reception result of the response signal from the portable device 12 in each transmission pattern in the case that at least the two transmission patterns are combined. The position detector 44 notifies the vehicle controller 41 of the detection result of the position of the portable device 12.

(Disposition examples of transmitting antennas)

Disposition examples of the transmitting antennas 23*a* to 23*c* will be described below with reference to FIG. 2.

The transmitting antenna 23*a* is disposed in the substantial center in a front portion in the vehicle. For example, the transmitting antenna 23*a* is disposed near a control panel (center console) between the driver seat 111D and the passenger seat 111P or in the substantial center in front of the control panel of the vehicle 101 such that directivity of the transmitting antenna 23*a* is oriented in a crosswise direction of the vehicle 101.

The transmitting antenna 23*b* is disposed in the substantial center in a rear portion in the vehicle. For example, the transmitting antenna 23*b* is disposed in front of a backrest of a rear seat 116 and near the center of the rear seat 116 such that the directivity of the transmitting antenna 23*b* is oriented in the front-back direction of the vehicle 101.

The transmitting antenna 23*c* is disposed in a side surface on the side of the driver seat 111D of the vehicle 101. For example, the transmitting antenna 23*c* is disposed in the door handle 113D located near the driver seat 111D in the side surface of the vehicle 101, a side mirror 114D, or a pillar 115D such that the directivity of the transmitting antenna 23*c* is oriented in the front-back direction of the vehicle 101. Therefore, without degrading an appearance of the vehicle 101, a space can effectively be used to provide the transmitting antenna 23*c*.

Hereinafter, the transmitting antennas 23*a* to 23*c* are simply referred to as a transmitting antenna 23 when there is no need to distinguish the transmitting antennas 23*a* to 23*c* from one another. The transmitting antenna 23*a* is also referred to as an antenna A, the transmitting antenna 23*b* is also referred to as an antenna B, and the transmitting antenna 23*c* is also referred to as an antenna C.

The receiving antenna 24 is disposed in any position, at which the response signal can successfully be received from the portable device 12 in the case that the portable device 12 exists in or around the vehicle 101, in the vehicle.

Any system may be adopted as the wireless communication system between the in-vehicle system 11 and the portable device 12 according to conditions such as a communication distance and consumed power. For example, an LF-band wireless communication is used in the communication from the in-vehicle system 11 to the portable device 12, and an UHF-band wireless communication is used in the communication from the portable device 12 to the in-vehicle system 11.

(Example of transmission pattern)

An example of the transmission pattern of the signal from the antennas A to C will be described below with reference to FIGS. 3 and 4.

FIGS. 3 and 4 illustrate five transmission patterns (1) to (5). Specifically, the area where the signal is transmitted from the antennas A to C in each transmission pattern is schematically illustrated in a field of "transmission area" in FIGS. 3 and 4. An outline area surrounded by a dotted line indicates the transmission area of the normal signal, and a diagonal-line area surrounded by a dotted line indicates the transmission area of the disturbing signal.

In FIGS. 3 and 4, a shape of each transmission area is illustrated by an elliptical shape for the purpose of easy understanding of the directivity of each transmitting antenna 23. However, actually each transmission area is not necessarily formed into the elliptical shape due to an influence of a metallic portion of a vehicle body. The transmission intensity from each transmitting antenna 23 is adjusted by taking advantage of such the property, which allows the normal signal or the disturbing signal to be transmitted within the desired range. For example, the normal signal or the disturbing signal can be transmitted in the whole inside of the vehicle 101 without leakage. The same holds true for the transmission area in FIGS. 11 and 15 described later.

The existence or non-existence, the kind, and the intensity of the transmitting signal from the antennas A to C are indicated in a field of "transmitting signal" in FIGS. 3 and 4. The intensity of the transmitting signal is indicated by four stages of large, medium, small, and no transmission. A value of the transmission intensity is a relative value in each antenna, accordingly the actual values of the transmission intensities are not necessarily equal to each other even if the identical values are indicated in the different antennas. For example, the small-intensity transmitting signal of the antenna A is not necessarily equal to the small-intensity transmitting signal of the antenna B in the actual value of the transmission intensity.

In the transmission pattern (1), the small-intensity normal signal is transmitted from the antenna C. Therefore, the normal signal is transmitted to a longitudinally long area Rc1 near the driver seat door 112D inside and outside of the vehicle 101. The antennas A and B do not transmit the signal.

Accordingly, the transmission pattern (1) is mainly used to detect the portable device 12 existing near the driver seat door 112D irrespective of the inside and the outside of the vehicle 101.

In the transmission pattern (2), the large-intensity normal signal is transmitted from the antenna A. Therefore, the normal signal is transmitted to a crosswise long area Ra2 in the front portion of the vehicle 101 and in the inside and outside near the front portion of the vehicle 101. The area Ra2 is set so as to include the neighborhood of the driver seat door 112D and the neighborhood of the passenger seat door 112P. The small-intensity disturbing signal is transmitted from the antenna B. Therefore, the disturbing signal is transmitted to a longitudinally long area Rb2 in the rear portion of the inside of the vehicle 101. The area Rb2 is set so as to include at least a space (such as the rear seat 116 and a luggage room (including a trunk)) in the rear portion inside the vehicle 101 and so as to spread out to a surrounding area of the vehicle 101 as little as possible. The small-intensity disturbing signal is transmitted from the antenna C. Therefore, the disturbing signal is transmitted to the area Rc2 similarly to the area Rc1 of the transmission pattern (1).

Accordingly, the transmission pattern (2) is mainly used to detect the portable device 12 existing near the passenger seat door 112P irrespective of the inside and the outside of the vehicle 101.

In the transmission pattern (3), the large-intensity disturbing signal is transmitted from the antenna A. Therefore, the disturbing signal is transmitted to the area Ra3 similarly to the area Ra2 of the transmission pattern (2). The large-intensity normal signal is also transmitted from the antenna B. Therefore, the normal signal is transmitted to a longitudinally long area Rb3 in the rear portion of the vehicle 101 and in the inside and outside near the rear portion of the vehicle 101. The area Rb3 is set so as to include the area near the tailgate 117 and so as to spread out in the crosswise direction of the vehicle 101 as little as possible. The antenna C does not transmit the signal.

Accordingly, the transmission pattern (3) is used to detect the portable device 12 existing in the space in the rear portion inside the vehicle or near the tailgate 117.

In the transmission pattern (4), the small-intensity disturbing signal is transmitted from the antenna A. Therefore, the normal signal is transmitted to a crosswise long area Ra4 in the front portion of the inside of the vehicle 101. the area Ra4 is set so as to include at least the space (such as the driver seat 111D and the passenger seat 111P) in the front portion inside the vehicle and so as to spread out to the surrounding area of the vehicle 101 as little as possible. The small-intensity disturbing signal is transmitted from the antenna B. Therefore, the normal signal is transmitted to an area Rb4 similarly to the area Rb2 of the transmission pattern (2). The antenna C does not transmit the signal.

Accordingly, the transmission pattern (4) is mainly used to detect the portable device 12 existing in the inside (including the luggage room) of the vehicle 101.

In the transmission pattern (5), the large-intensity disturbing signal is transmitted from the antenna A. Therefore, the disturbing signal is transmitted to an area Ra5 similarly to the area Ra3 of the transmission pattern (3). The large-intensity disturbing signal is transmitted from the antenna B. Therefore, the disturbing signal is transmitted to an area Rb5 similarly to the area Rb3 of the transmission pattern (3). The large-intensity normal signal is also transmitted from the antenna C. Therefore, the normal signal is transmitted to a longitudinally long area Rc5 including the whole vehicle 101 and the surrounding area of the vehicle 101.

Accordingly, the transmission pattern (5) is mainly used to detect the portable device 12 existing in the surrounding area of the vehicle 101 and the area except the driver seat door 112D, the passenger seat door 112P, and the neighborhood of the tailgate 117.

(Processing of in-vehicle system 11)

The processing of the in-vehicle system 11 will be described below with reference to FIGS. 5 to 10.

Figure 5:
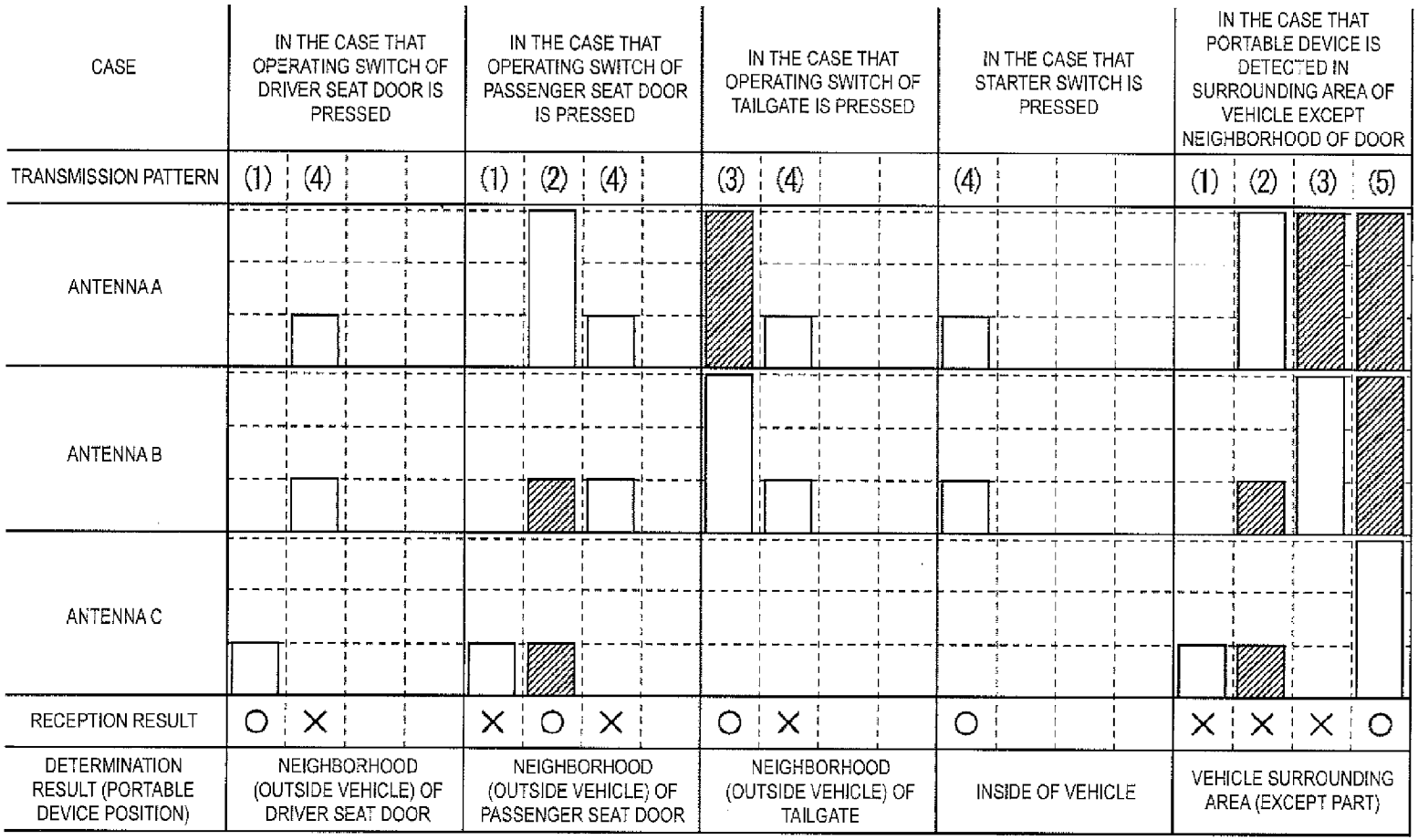
FIG. 5 is a view illustrating an example of a combination of the transmission patterns.

FIG. 5 illustrates an example of a combination of the transmission patterns used to detect the position of the portable device 12.

The case that the signal is transmitted from the antennas A to C is indicated in a field of "case" in FIG. 5.

The combination of the transmission patterns in each case is indicated in a field of "transmission pattern". A numerical character in parenthesis in the field of "transmission pattern" is matched with a numerical character in parenthesis of each transmission pattern in FIGS. 3 and 4.

The existence or non-existence, the kind, and the intensity of the signal transmitted from each antenna are indicated in fields of "antenna A" to "antenna C". Specifically, the intensity of the transmitting signal is indicated by four stages of large, medium, small and zero (no transmission) by a bar graph. The normal signal is indicated by an outline bar graph, and the disturbing signal is indicated by a diagonal-line bar graph.

The reception result of the response signal expected in each transmission pattern is indicated in a field of "reception result". In the transmission pattern, an open circle indicates that the response signal is expected to be received from the portable device 12, and an x-mark indicates that the response signal is expected not to be received from the portable device 12.

The position, at which the portable device 12 exists in the case that the reception result of the response signal meets the expectation indicated in the "reception result", is indicated in a field of "determination result (portable device position) ". That is, a determination that the portable device 12 exists at the position indicated in the "determination result (portable device position) " is made in the case that the reception result of the response signal meets the expectation indicated in the "reception result". On the other hand, the determination that the portable device 12 does not exist at the position indicated in the "determination result (portable device position) " is made in the case that the reception result of the response signal does not meet the expectation indicated in the "reception result".

(Processing in the case that operating switch 31 of driver seat door 112D is pressed)

The processing of the in-vehicle system 11 in the case that the operating switch 31 of the driver seat door 112D is pressed will be described with reference to flowcharts in FIGS. 5 and 6. For example, the operating switch 31 of the driver seat door 112D is pressed, the signal indicating the operating content is supplied to the vehicle controller 41, and the vehicle controller 41 notifies the transmission controller 42 that the operating switch 31 is pressed, thereby starting the processing.

In Step S1, the in-vehicle system 11 transmits the signal of the transmission pattern (1). Specifically, the transmission controller 42 performs the control such that the small-intensity normal signal is transmitted from the antenna C and such that the signal is not transmitted from the antennas A and B. The transmission controller 42 notifies the position detector 44 that the signal of the transmission pattern (1) is transmitted.

In Step S2, the position detector 44 determines whether the portable device 12 exists near the driver seat door 112D. Specifically, the position detector 44 authenticates the authentication information included in the response signal in the case that the response signals of the signal transmission of the transmission pattern (1) is received from the portable device 12 through the receiving antenna 24 and the receiving part 43. For example, the authentication is performed by checking the authentication information previously stored in the vehicle 101 against the authentication information included in the response signal. When successfully performing the authentication information, the position detector 44 determines that the portable device 12 exists near the driver seat door 112D. Then the processing goes to step S3.

In Step S3, the in-vehicle system 11 transmits the signal of the transmission pattern (4). Specifically, the transmission controller 42 performs the control such that the small-intensity normal signal is transmitted from the antennas A and B and such that the signal is not transmitted from the antenna C. The transmission controller 42 notifies the position detector 44 that the signal of the transmission pattern (4) is transmitted.

In Step S4, the position detector 44 determines whether the portable device 12 exists in the vehicle. Specifically, the position detector 44 determines that the portable device 12 does not exist in the vehicle in the case that the position detector 44 does not receive the response signal of the signal transmission of the transmission pattern (4), or in the case that the position detector 44 fails in the authentication while receiving the response signal. Then the processing goes to Step S5.

In Step S5, the in-vehicle system 11 performs an entry operation of the driver seat 111D. Specifically, the position detector 44 determines that the portable device 12 exists near the driver seat door 112D and outside the vehicle from the determination result, and notifies the vehicle controller 41 of the determination result.

The vehicle controller 41 locks or unlocks the driver seat door 112D. For example, in the case that the operating switch 31 is constructed by the locking and unlocking switches, the vehicle controller 41 controls an actuator to lock or unlock the driver seat door 112D according to the operated switch. For example, in the case that the operating switches 31 is constructed by the one common locking and unlocking switch, the vehicle controller 41 controls the actuator to unlock the driver seat door 112D when the driver seat door 112D is locked, and the vehicle controller 41 controls the actuator to lock the driver seat door 112D when the driver seat door 112D is unlocked.

In order to make the notification that the driver seat door 112D is locked or unlocked, for example, the vehicle controller 41 blinks a hazard flasher in a predetermined pattern or rings a buzzer in a predetermined pattern.

Then the processing is ended.

On the other hand, in Step S4, the position detector 44 determines that the portable device 12 exists in the vehicle in the case that the position detector 44 receives the response signal of the signal transmission of the transmission pattern (4) from the portable device 12, and in the case that the position detector 44 successfully authenticates the authentication information included in the response signal. Then the processing goes to Step S6.

In Step S2, the position detector 44 determines that the portable device 12 does not exist near the driver seat door 112D in the case that the position detector 44 does not receive the response signal of the signal transmission of the transmission pattern (1), or in the case that the position detector 44 fails in the authentication while receiving the response signal. Then the processing goes to Step S6.

In Step S6, the in-vehicle system 11 does not perform the entry operation of the driver seat 111D. Specifically, the position detector 44 determines that the portable device 12 does not exist near the driver seat door 112D and outside the vehicle, and notifies the vehicle controller 41 of the determination result. In this case, the vehicle controller 41 does not lock and unlock the driver seat door 112D. However, the vehicle controller 41 may make the notification that the vehicle controller 41 does not lock and unlock the driver seat door 112D using the hazard flasher or the buzzer.

Then the processing is ended.

(Processing in the case that operating switch 32 of passenger seat door 112P is pressed)

The processing of the in-vehicle system 11 in the case that the operating switch 32 of the passenger seat door 112P is pressed will be described with reference to FIGS. 5 and 7. For example, the operating switch 32 of the passenger seat door 112P is pressed, the signal indicating the operating content is supplied to the vehicle controller 41, and the vehicle controller 41 notifies the transmission controller 42 that the operating switch 32 is pressed, thereby starting the processing.

Figure 6:
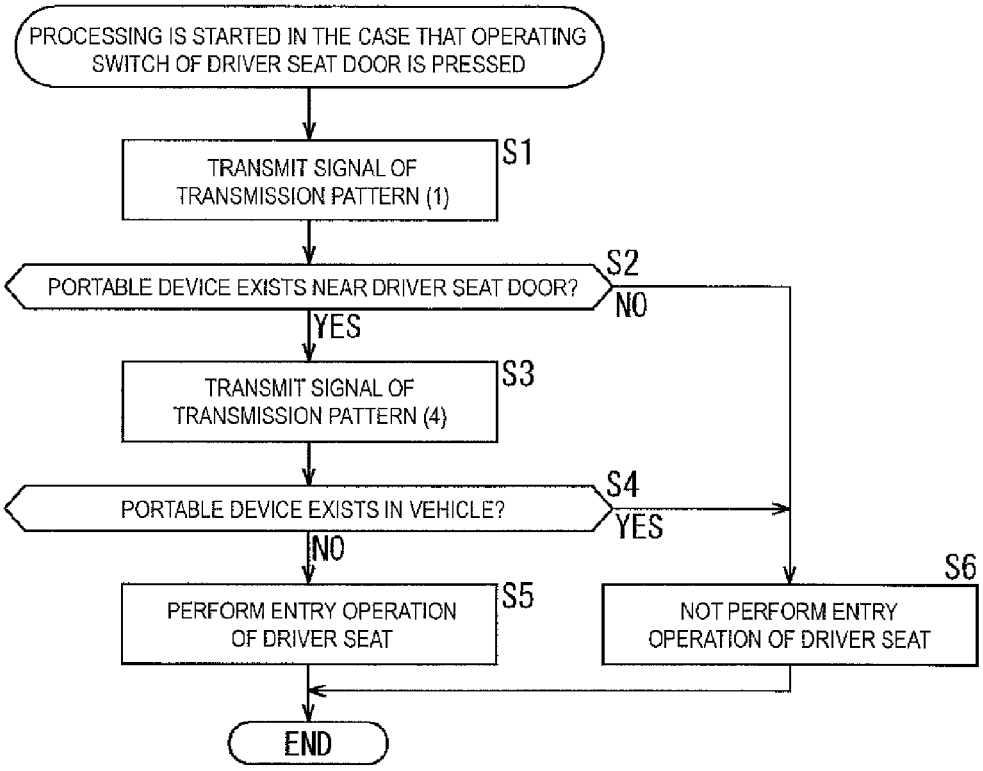
FIG. 6 is a flowchart illustrating processing when an operating switch of a driver seat door is pressed.

In Step S21, similarly to the processing in Step S1 of FIG. 6, the signal of the transmission pattern (1) is transmitted.

In Step S22, similarly to the processing in Step S2 of FIG. 6, whether the portable device 12 exists near the driver seat door 112D is determined. When it is determined that the portable device 12 does not exist near the driver seat door 112D in Step S22, the processing goes to Step S23.

In Step S23, the in-vehicle system 11 transmits the signal of the transmission pattern (2). Specifically, the transmission controller 42 performs the control such that the large-intensity normal signal is transmitted from the antenna A and such that the small-intensity disturbing signal is transmitted from the antennas B and C. The transmission controller 42 notifies the position detector 44 that the signal of the transmission pattern (2) is transmitted.

In Step S24, the position detector 44 determines whether the portable device 12 exists near the passenger seat door 112P. Specifically, the position detector 44 determines that the portable device 12 exists near the passenger seat door 112P in the case that the position detector 44 receives the response signal of the signal transmission of the transmission pattern (2) from the portable device 12 through the receiving antenna 24 and the receiving part 43, and in the case that the position detector 44 successfully authenticates the authentication information included in the response signal. Then the processing goes to Step S25.

In Step S25, similarly to the processing in Step S3 of FIG. 6, the signal of the transmission pattern (4) is transmitted.

In Step S26, similarly to the processing in Step S4 of FIG. 6, whether the portable device 12 exists in the vehicle is determined. When it is determined that the portable device 12 does not exist in the vehicle in Step S26, the processing goes to Step S27.

In Step S27, the in-vehicle system 11 performs the entry operation of the passenger seat 111P. Specifically, the position detector 44 determines that the portable device 12 exists near the passenger seat door 112P and outside the vehicle from the determination result, and notifies the vehicle controller 41 of the determination result.

The vehicle controller 41 locks or unlocks the passenger seat door 112P. For example, in the case that the operating switch 32 is constructed by the locking and unlocking switches, the vehicle controller 41 controls the actuator to lock or unlock the passenger seat door 112P according to the operated switch. For example, in the case that the operating switches 32 is constructed by the one common locking and unlocking switch, the vehicle controller 41 controls the actuator to unlock the passenger seat door 112P when the passenger seat door 112P is locked, and the vehicle controller 41 controls the actuator to lock the passenger seat door 112P when the passenger seat door 112P is unlocked.

In order to make the notification that the passenger seat door 112P is locked or unlocked, for example, the vehicle controller 41 blinks the hazard flasher in the predetermined pattern or rings the buzzer in the predetermined pattern.

Then the processing is ended.

When it is determined that the portable device 12 exists in the vehicle in Step S26, the processing goes to Step S28.

In Step S24, the position detector 44 determines that the portable device 12 does not exist near the passenger seat door 112P in the case that the position detector 44 does not receive the response signal of the signal transmission of the transmission pattern (2), or in the case that the position detector 44 fails in the authentication while receiving the response signal. Then the processing goes to Step S28.

When it is determined that the portable device 12 exists near the driver seat door 112D in Step S22, the processing goes to Step S28.

In Step S28, the in-vehicle system 11 does not perform the entry operation of the passenger seat 111P. Specifically, the position detector 44 determines that the portable device 12 does not exist near the passenger seat door 112P and outside the vehicle, and notifies the vehicle controller 41 of the determination result. In this case, the vehicle controller 41 does not lock and unlock the passenger seat door 112P. However, the vehicle controller 41 may make the notification that the vehicle controller 41 does not lock and unlock the driver seat door 112P using the hazard flasher or the buzzer.

Then the processing is ended.

Figure 7:
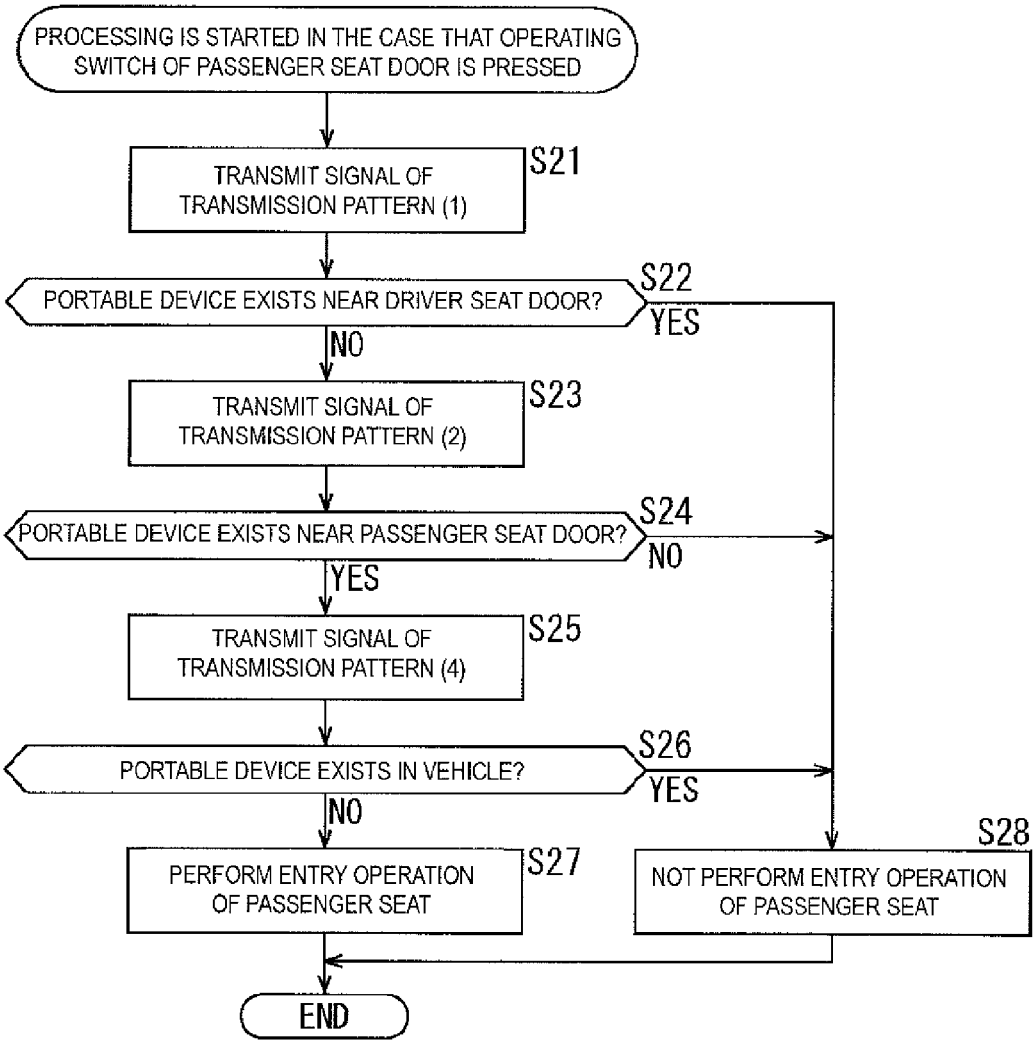
FIG. 7 is a flowchart illustrating processing when the operating switch of a passenger seat door is pressed.

In the processing in FIG. 7, the signal transmission of the transmission pattern (1) and the corresponding determination processing can be eliminated as needed basis.

(Processing in the case that operating switch 33 of tailgate 117 is pressed)

The processing of the in-vehicle system 11 in the case that the operating switch 33 of the tailgate 117 is pressed will be described with reference to FIGS. 5 and 8. For example, the operating switch 33 of the tailgate 117 is pressed, the signal indicating the operating content is supplied to the vehicle controller 41, and the vehicle controller 41 notifies the transmission controller 42 that the operating switch 33 is pressed, thereby starting the processing.

In Step S41, the in-vehicle system 11 transmits the signal of the transmission pattern (3). Specifically, the transmission controller 42 performs the control such that the large-intensity disturbing signal is transmitted from the antenna A, such that the large-intensity normal signal is transmitted from the antenna B and such that the signal is not transmitted from the antenna C. The transmission controller 42 notifies the position detector 44 that the signal of the transmission pattern (3) is transmitted.

In Step S42, the position detector 44 determines whether the portable device 12 exists in the space in the rear portion inside the vehicle or near the tailgate 117. The position detector 44 determines that the portable device 12 exists in the space in the rear portion inside the vehicle or near the tailgate 117 in the case that the position detector 44 receives the response signal of the signal transmission of the transmission pattern (3) from the portable device 12 through the receiving antenna 24 and the receiving part 43, and in the case that the position detector 44 successfully authenticates the authentication information included in the response signal. Then the processing goes to Step S43.

In Step S43, similarly to the processing in Step S3 of FIG. 6, the signal of the transmission pattern (4) is transmitted.

In Step S44, similarly to the processing in Step S4 of FIG. 6, whether the portable device 12 exists in the vehicle is determined. When it is determined that the portable device 12 does not exist in the vehicle in Step S44, the processing goes to Step S45.

In Step S45, the in-vehicle system 11 performs the entry operation of the tailgate 117. Specifically, the position detector 44 determines that the portable device 12 exists near the tailgate 117D and outside the vehicle from the determination result, and notifies the vehicle controller 41 of the determination result.

The vehicle controller 41 locks or unlocks the tailgate 117. For example, in the case that the operating switch 33 is constructed by the locking and unlocking switches, the vehicle controller 41 controls the actuator to lock or unlock the tailgate 117 according to the operated switch. For example, in the case that the operating switch 33 is constructed by the one common locking and unlocking switch, the vehicle controller 41 controls the actuator to unlock the tailgate 117 when the tailgate 117 is locked, and the vehicle controller 41 controls the actuator to lock the tailgate 117 when the tailgate 117 is unlocked.

In order to make the notification that the tailgate 117 is locked or unlocked, for example, the vehicle controller 41 blinks the hazard flasher in the predetermined pattern or rings the buzzer in the predetermined pattern.

Then the processing is ended.

When it is determined that the portable device 12 exists in the vehicle in Step S44, the processing goes to Step S46.

In Step S42, the position detector 44 determines that the portable device 12 does not exist in the space in the rear portion inside the vehicle and near the tailgate 117 in the case that the position detector 44 does not receive the response signal of the signal transmission of the transmission pattern (3), or in the case that the position detector 44 fails in the authentication while receiving the response signal. Then the processing goes to Step S46.

In Step S46, the in-vehicle system 11 does not perform the entry operation of the tailgate 117. Specifically, the position detector 44 determines that the portable device 12 does not exist near the tailgate 117 and outside the vehicle, and notifies the vehicle controller 41 of the determination result. In this case, the vehicle controller 41 does not lock and unlock the tailgate 117. However, the vehicle controller 41 may make the notification that the vehicle controller 41 does not lock and unlock the tailgate 117 using the hazard flasher or the buzzer.

Then the processing is ended.

(Processing in the case that starter switch 34 in vehicle is pressed)

Figure 9:
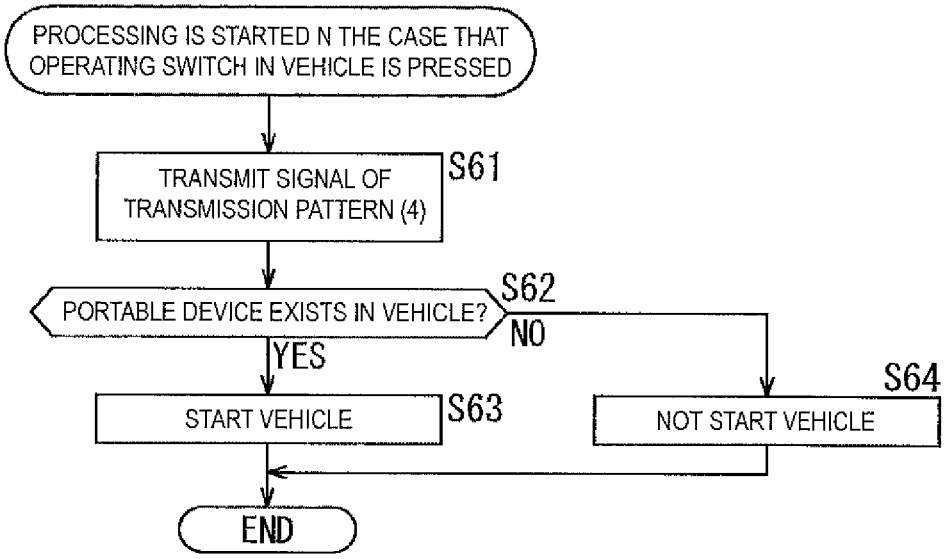
FIG. 9 is a flowchart illustrating processing when a starter switch in a vehicle is pressed.

The processing of the in-vehicle system 11 in the case that the starter switch 34 in the vehicle is pressed will be described with reference to FIGS. 5 and 9. For example, the starter switch 34 in the vehicle is pressed, the signal indicating the operating content is supplied to the vehicle controller 41, and the vehicle controller 41 notifies the transmission controller 42 that the starter switch 34 are pressed, thereby starting the processing.

In Step S61, similarly to the processing in Step S3 of FIG. 6, the signal of the transmission pattern (4) is transmitted.

In Step S62, similarly to the processing in Step S4 of FIG. 6, whether the portable device 12 exists in the vehicle is determined. When it is determined that the portable device 12 exists in the vehicle in Step S62, the processing goes to Step S63.

In Step S63, the in-vehicle system 11 starts the vehicle 101. Specifically, the position detector 44 notifies the vehicle controller 41 of the determination result that the portable device 12 exists in the vehicle. For example, in the case that the vehicle 101 is an engine vehicle or a hybrid car, the vehicle controller 41 issues a command to start the engine to the ECU (Engine control Unit) that controls the engine of the vehicle 101. On the other hand, in the case that the vehicle 101 is an electric automobile, the vehicle controller 41 directly starts the motor of the vehicle 101 or issues the command to start the motor to the ECU that controls the motor of the vehicle 101.

Then the processing is ended.

On the other hand, when it is determined that the portable device 12 does not exist in the vehicle in Step S62, the processing goes to Step S64.

In Step S64, the in-vehicle system 11 does not start the vehicle 101. Specifically, the position detector 44 notifies the vehicle controller 41 of the determination result that the portable device 12 does not exist in the vehicle. In this case, the vehicle controller 41 does not start the engine or the motor of the vehicle 101. However, the vehicle controller 41 may make the notification that the vehicle controller 41 does not start the engine or the motor of the vehicle 101 using the buzzer.

Then the processing is ended.

(Processing in the case that portable device 12 in surrounding area of vehicle 101 except neighborhood of door is detected)

The processing in the case that the portable device 12 in the surrounding area of the vehicle 101 except the neighborhood of the door is detected will be described below with reference to FIGS. 5 and 10. For example, the processing is performed in the case that the portable device 12 is previously authenticated. As used herein, the neighborhood of the door means the neighborhood of the driver seat door 112D, the neighborhood of the passenger seat door 112P, and the neighborhood of the tailgate 117.

In Step S81, similarly to the processing in Step S1 of FIG. 6, the signal of the transmission pattern (1) is transmitted.

In Step S82, similarly to the processing in Step S2 of FIG. 6, whether the portable device 12 exists near the driver seat door 112D is determined. When it is determined that the portable device 12 does not exist near the driver seat door 112D in Step S82, the processing goes to Step S83.

In Step S83, similarly to the processing in Step S23 of FIG. 7, the signal of the transmission pattern (2) is transmitted.

In Step S84, similarly to the processing in Step S24 of FIG. 7, whether the portable device 12 exists near the passenger seat door 112P is determined. When it is determined that the portable device 12 does not exist near the passenger seat door 112P in Step S84, the processing goes to Step S85.

Figure 8:
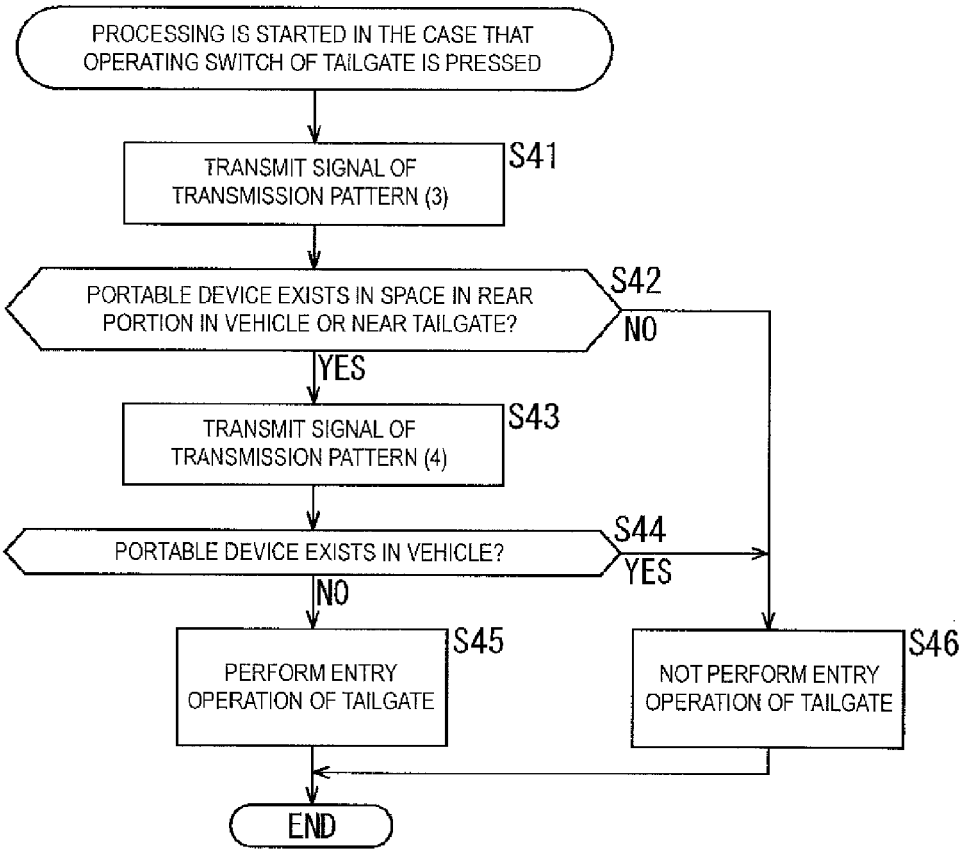
FIG. 8 is a flowchart illustrating processing when the operating switch of a tailgate is pressed.

In Step S85, similarly to the processing in Step S41 of FIG. 8, the signal of the transmission pattern (3) is transmitted.

In Step S86, similarly to the processing in Step S42 of FIG. 8, whether the portable device 12 exists in the space in the rear portion in the vehicle or near the tailgate 117 is determined. When it is determined that the portable device 12 does not exist in the space in the rear portion in the vehicle or near the tailgate 117 in Step S86, the processing goes to Step S87.

In Step S87, the in-vehicle system 11 transmits the signal of the transmission pattern (5). Specifically, the transmission controller 42 performs the control such that the large-intensity disturbing signal is transmitted from the antennas A and B and such that the large-intensity normal signal is transmitted from the antenna C. The transmission controller 42 notifies the position detector 44 that the signal of the transmission pattern (5) is transmitted.

In Step S88, the position detector 44 determines whether the portable device 12 exists in the surrounding area of the vehicle 101 except the driver seat door 112D, the passenger seat door 112P, and the neighborhood of the tailgate 117. Specifically, the position detector 44 receives the response signal of the signal transmission of the transmission pattern (5) from the portable device 12 through the receiving antenna 24 and the receiving part 43, and the position detector 44 determines that the portable device 12 exists in the surrounding area of the vehicle 101 except the driver seat door 112D, the passenger seat door 112P, and the neighborhood of the tailgate 117 when the position detector 44 successfully authenticates the authentication information included in the response signal. Then the processing goes to Step S89.

In Step S89, the in-vehicle system 11 performs the processing according to the detection of the portable device 12. Specifically, the position detector 44 determines that the portable device 12 exists in the surrounding area of the vehicle 101 except the neighborhood of the door from the determination result, and notifies the vehicle controller 41 of the determination result.

The vehicle controller 41 performs the processing in the case that the portable device 12 exists in the surrounding area of the vehicle 101 except the neighborhood of the door. For example, the vehicle controller 41 predicts that a user who has the portable device 12 gets in the vehicle 101, and the vehicle controller 41 performs the corresponding processing.

Then the processing is ended.

On the other hand, when the position detector 44 does not receive the response signal of the signal transmission of the transmission pattern (5) in Step S88, or when the position detector 44 fails in the authentication while receiving the response signal in Step S88, the position detector 44 determines that the portable device 12 does not exist in the surrounding area of the vehicle 101 except the driver seat door 112D, the passenger seat door 112P, and the neighborhood of the tailgate 117. Then the processing in Step S89 is skipped, and the processing is ended.

When it is determined that the portable device 12 exists in the space in the rear portion in the vehicle or the neighborhood of the tailgate 117 in Step S86, the pieces of processing in Steps S87 to S89 are skipped, and the processing is ended.

When it is determined that the portable device 12 exists near the passenger seat door 112P in Step S84, the pieces of processing in Steps S85 to S89 are skipped, and the processing is ended.

When it is determined that the portable device 12 exists near the driver seat door 112D in Step S82, the pieces of processing in Steps S83 to S89 is skipped, and the processing is ended.

Figure 10:
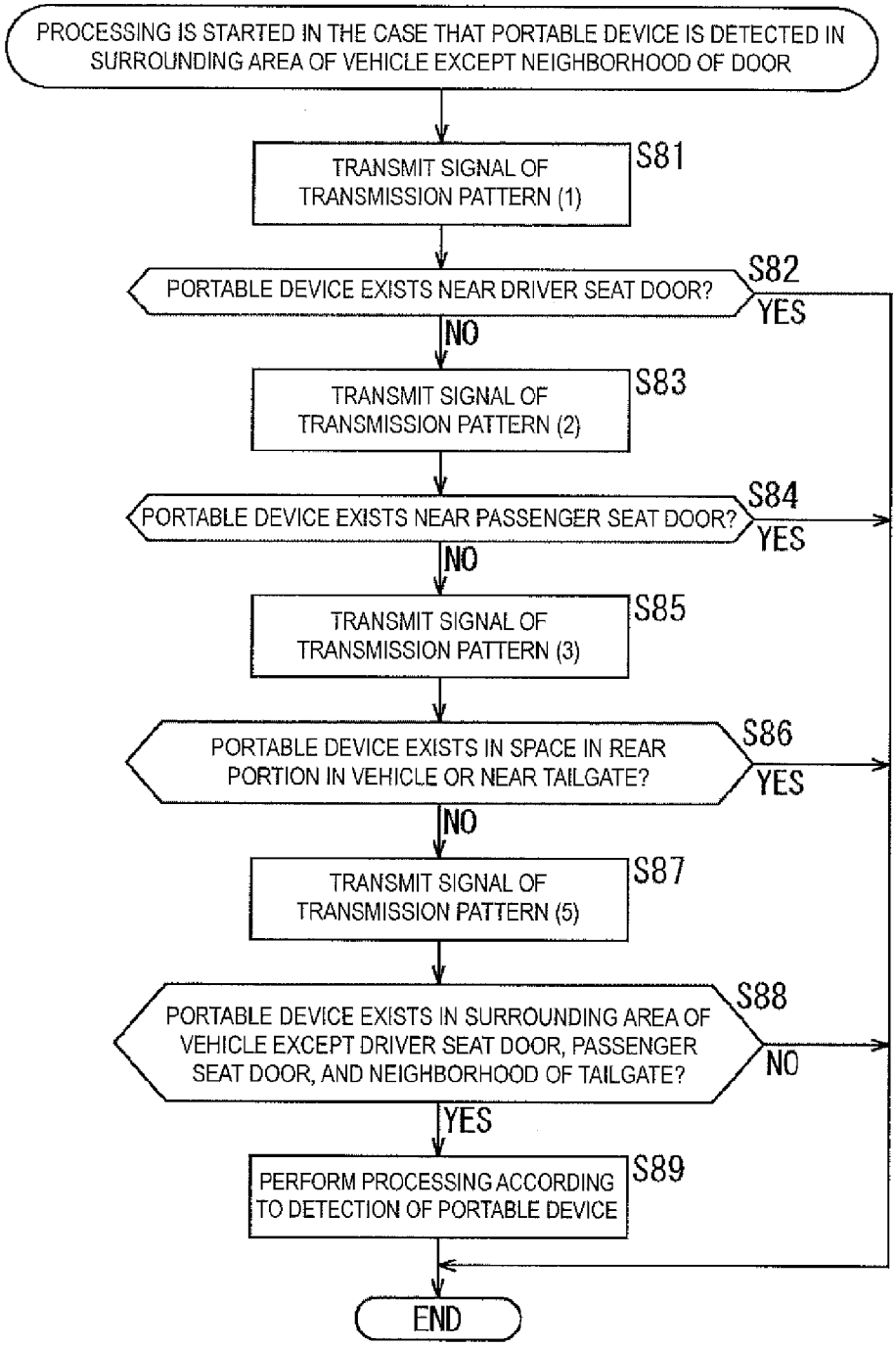
FIG. 10 is a flowchart illustrating processing of detecting a portable device around the vehicle except a neighborhood of a door.

In the processing in FIG. 10, the signal transmissions of the transmission patterns (1) to (3) and the corresponding pieces of determination processing can be eliminated as needed basis.

As described above, using the three transmitting antennas 23, the position of the portable device 12 can accurately be detected near the vehicle 101. The vehicle 101 can surely be controlled according to the position of the portable device 12.

2. Modifications

Modifications of one or more of the above the embodiments will be described below.

(Modification of method for detecting position of portable device 12)

the above method for detecting the position of the portable device 12 is described by way of example, and various modifications are conceivable.

A first modification of the method for detecting the position of the portable device 12 will be described with reference to FIGS. 11 to 14.

(First modification of transmission pattern)

FIG. 11 illustrates transmission patterns (6) and (7) as a first modification of the transmission pattern.

In the transmission pattern (6), the large-intensity normal signal is transmitted from the antenna C. Therefore, the normal signal is transmitted to an area Rc6 similarly to the area Rc5 of the transmission pattern (5) in FIG. 4. The antennas A and B do not transmit the signal.

Accordingly, the transmission pattern (6) is used to detect the portable device 12 existing in the vehicle 101 or a predetermined range in the surrounding area of the vehicle 101.

In the transmission pattern (7), the large-intensity disturbing signal is transmitted from the antenna A. Therefore, the normal signal is transmitted to an area Ra7 similarly to the area Ra2 of the transmission pattern (2) in FIG. 3. The large-intensity disturbing signal is transmitted from the antenna B. Therefore, the normal signal is transmitted to an area Rb7 similarly to the area Ra3 of the transmission pattern (3) in FIG. 3. The antenna C does not transmit the signal.

Accordingly, the transmission pattern (7) is mainly used to detect the portable device 12 existing in the space in the front portion in the vehicle 101, near the driver seat door 112D, or near the passenger seat door 112P.

(First modification of processing in the case that operating switch 31 of driver seat door 112D is pressed)

A first modification of the processing of the in-vehicle system 11 in the case that the operating switch 31 of the driver seat door 112D is pressed will be described below with reference to flowcharts in FIGS. 12 and 13. FIG. 12 illustrates an example of the combination of the transmission patterns similarly to FIG. 5.

In Step S101, the in-vehicle system 11 transmits the signal of the transmission pattern (6). Specifically, the transmission controller 42 performs the control such that the large-intensity normal signal is transmitted from the antenna C and such that the signal is not transmitted from the antennas A and B. The transmission controller 42 notifies the position detector 44 that the signal of the transmission pattern (6) is transmitted.

In Step S102, the position detector 44 determines whether the portable device 12 exists in the vehicle 101 or the surrounding area of the vehicle 101. Specifically, the position detector 44 determines that the portable device 12 exists in the vehicle 101 or the surrounding area of the vehicle 101 in the case that the position detector 44 receives the response signal of the signal transmission of the transmission pattern (6) from the portable device 12 through the receiving antenna 24 and the receiving part 43, and in the case that the position detector 44 successfully authenticates the authentication information included in the response signal. Then the processing goes to Step S103.

In Step S103, the in-vehicle system 11 transmits the signal of the transmission pattern (7). Specifically, the transmission controller 42 performs the control such that the large-intensity normal signal is transmitted from the antenna A, such that the large-intensity disturbing signal is transmitted from the antenna B and such that the signal is not transmitted from the antenna C. The transmission controller 42 notifies the position detector 44 that the signal of the transmission pattern (7) is transmitted.

In Step S104, the position detector 44 determines whether the portable device 12 exists in the space in the front portion in the vehicle 101, near the driver seat door 112D, or near the passenger seat door 112P. Specifically, the position detector 44 determines that the portable device 12 exists in the space in the front portion in the vehicle 101, near the driver seat door 112D, or near the passenger seat door 112P in the case that the position detector 44 receives the response signal of the signal transmission of the transmission pattern (7) from the portable device 12 through the receiving antenna 24 and the receiving part 43, and in the case that the position detector 44 successfully authenticates the authentication information included in the response signal. Then the processing goes to Step S105.

In Step S105, similarly to the processing in Step S23 of FIG. 7, the signal of the transmission pattern (2) is transmitted.

In Step S106, similarly to the processing in Step S24 of FIG. 7, whether the portable device 12 exists near the passenger seat door 112P is determined. When it is determined that the portable device 12 does not exist near the passenger seat door 112P in Step S106, the processing goes to Step S107.

In Step S107, similarly to the processing in Step S3 of FIG. 6, the signal of the transmission pattern (4) is transmitted.

In Step S108, similarly to the processing in Step S4 of FIG. 6, whether the portable device 12 exists in the vehicle is determined. When it is determined that the portable device 12 does not exist in the vehicle in Step S108, the processing goes to Step S109.

In Step S109, the entry operation of the driver seat 111D is performed similarly to the processing in Step S5 of FIG. 6. Then the processing is ended.

When it is determined that the portable device 12 exists in the vehicle in step S108, the processing goes to Step S110.

When it is determined that the portable device 12 exists near the passenger seat door 112P in Step S106, the processing goes to Step S110.

In Step S104, the position detector 44 determines that the portable device 12 does not exist in the space in front of the vehicle 101, near the driver seat door 112D, and near the passenger seat door 112P in the case that the position detector 44 does not receive the response signal of the signal transmission of the transmission pattern (7), or in the case that the position detector 44 fails in the authentication while receiving the response signal. Then the processing goes to Step S110.

In Step S102, the position detector 44 determines that the portable device 12 does not exist in the vehicle 101 and the surrounding area of the vehicle 101 in the case that the position detector 44 does not receive the response signal of the signal transmission of the transmission pattern (6), or in the case that the position detector 44 fails in the authentication while receiving the response signal. Then the processing goes to Step S110.

In Step S110, the entry operation of the driver seat 111D is not performed similarly to the processing in Step S6 of FIG. 6. Then the processing is ended.

Figure 13:
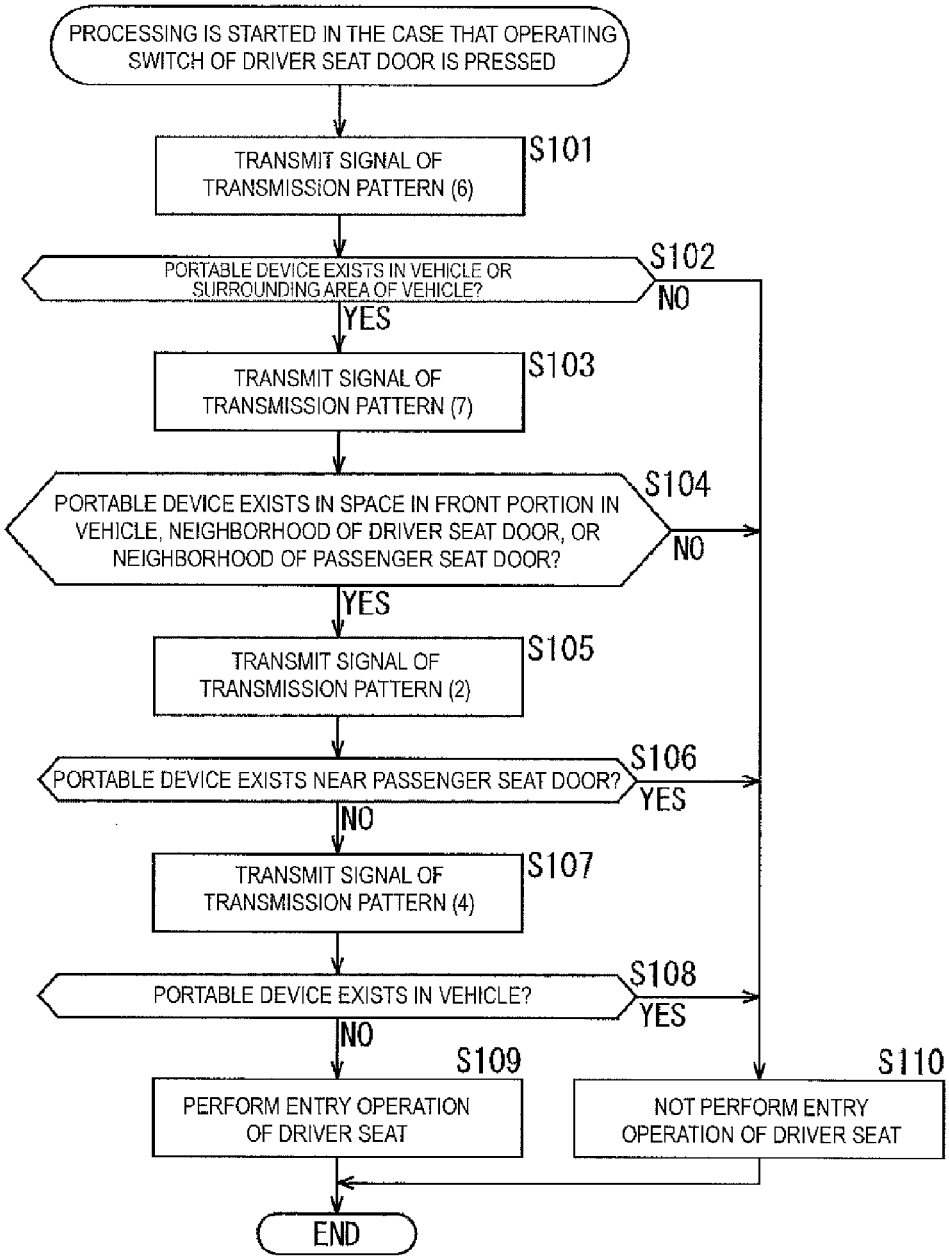
FIG. 13 is a flowchart illustrating a first modification of the processing when the operating switch of the driver seat door is pressed.

In the processing in FIG. 13, the signal transmission of the transmission pattern (6) and the corresponding determination processing can be eliminated as needed basis.

(First modification of processing in the case that operating switch 32 of passenger seat door 112P is pressed)

A first modification of the processing of the in-vehicle system 11 in the case that the operating switch 32 of the passenger seat door 112P is pressed will be described below with reference to flowcharts in FIGS. 12 and 14.

In Step S121, similarly to the processing in Step S101 of FIG. 13, the signal of the transmission pattern (6) is transmitted.

In Step S122, similarly to the processing in Step S102 of FIG. 13, whether the portable device 12 exists in the vehicle 101 or the surrounding area of the vehicle 101 is determined. When it is determined that the portable device 12 exists in the vehicle 101 or the surrounding area of the vehicle 101 in Step S122, the processing goes to Step S123.

In Step S123, similarly to the processing in Step S103 of FIG. 13, the signal of the transmission pattern (7) is transmitted.

In Step S124, similarly to the processing in Step S104 of FIG. 13, whether the portable device 12 exists in the space in the front portion in the vehicle 101, near the driver seat door 112D, or near the passenger seat door 112P is determined. When it is determined that the portable device 12 exists in the space in the front portion in the vehicle 101, near the driver seat door 112D, or near the passenger seat door 112P in Step S124, the processing goes to Step S125.

In Step S125, similarly to the processing in Step S23 of FIG. 7, the signal of the transmission pattern (2) is transmitted.

In Step S126, similarly to the processing in Step S24 of FIG. 7, whether the portable device 12 exists near the passenger seat door 112P is determined. When it is determined that the portable device 12 exists near the passenger seat door 112P in Step S126, the processing goes to Step S127.

In Step S127, similarly to the processing in Step S3 of FIG. 6, the signal of the transmission pattern (4) is transmitted.

In Step S128, similarly to the processing in Step S4 of FIG. 6, whether the portable device 12 exists in the vehicle is determined. When it is determined that the portable device 12 does not exist in the vehicle in Step S128, the processing goes to Step S129.

In Step S129, the entry operation of the passenger seat 111P is performed similarly to the processing in Step S27 of FIG. 7. Then the processing is ended.

When it is determined that the portable device 12 exists in the vehicle in Step S128, the processing goes to Step S130.

When it is determined that the portable device 12 does not exist near the passenger seat door 112P in Step S126, the processing goes to Step S130.

When it is determined that the portable device 12 does not exist in the space in front of the vehicle 101, near the driver seat door 112D, and near the passenger seat door 112P in Step S124, the processing goes to Step S130.

When it is determined that the portable device 12 does not exist in the vehicle 101 and the surrounding area of the vehicle 101 in Step S122, the processing goes to Step S130.

In Step S130, the entry operation of the passenger seat 111P is not performed similarly to the processing in Step S28 of FIG. 7. Then the processing is ended.

Figure 14:
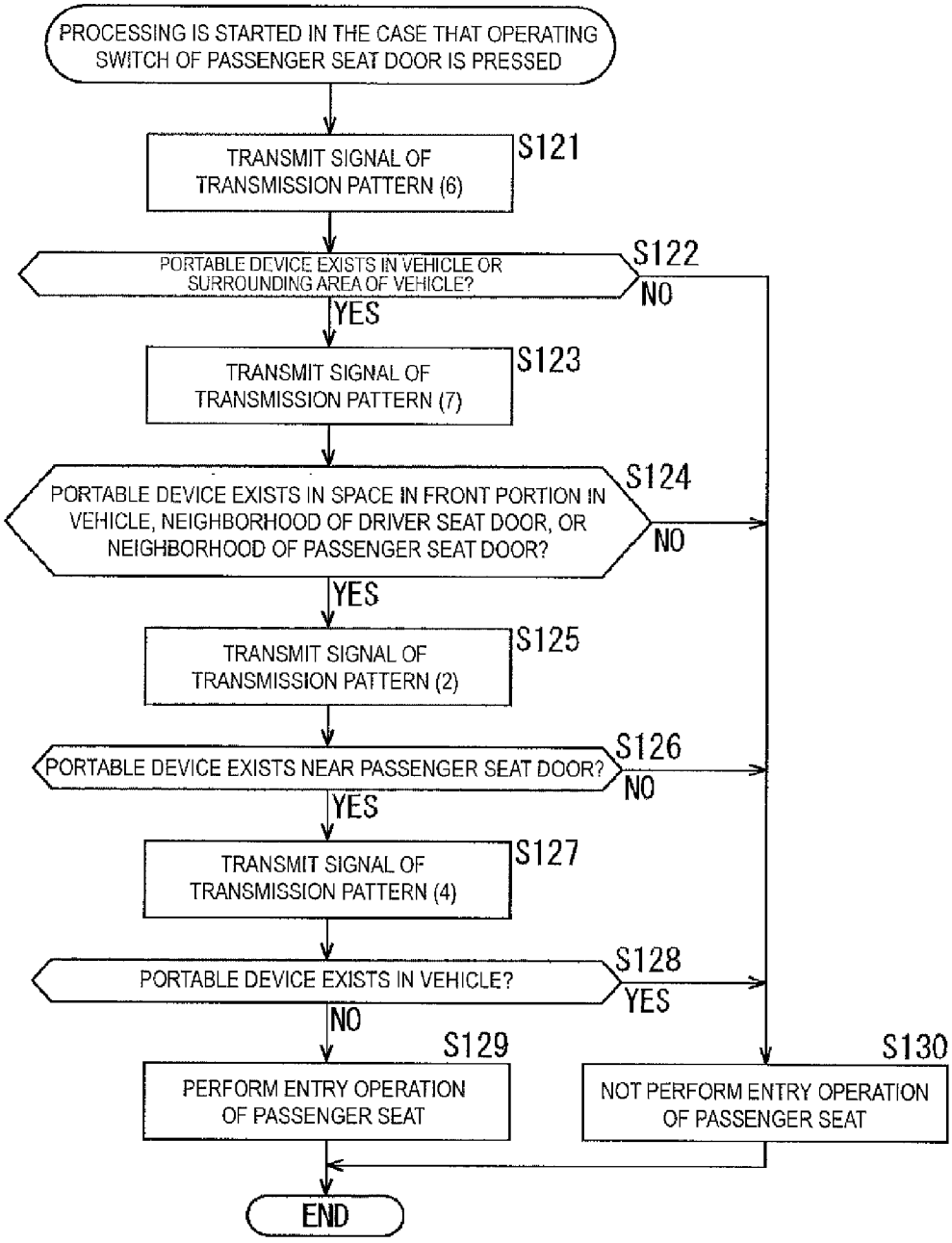
FIG. 14 is a flowchart illustrating a first modification of the processing when the operating switch of the passenger seat door is pressed.

In the processing in FIG. 14, the signal transmissions of the transmission patterns (6) and (7) and the corresponding pieces of determination processing can be eliminated as needed basis.

A second modification of the method for detecting the position of the portable device 12 will be described with reference to FIGS. 15 to 19.

(Second modification of transmission pattern)

FIG. 15 illustrates transmission patterns (8) and (9) as a second modification of the transmission pattern.

In the transmission pattern (8), the small-intensity disturbing signal is transmitted from the antenna A. Therefore, the disturbing signal is transmitted to an area Ra8 similarly to the area Ra4 of the transmission pattern (4) in FIG. 4. The small-intensity disturbing signal is transmitted from the antenna B. Therefore, the disturbing signal is transmitted to an area Rb8 similarly to the area Rb2 of the transmission pattern (2) in FIG. 3. The medium-intensity normal signal is also transmitted from the antenna C. Therefore, the normal signal is transmitted to the substantially whole area except the left rear portion in the vehicle 101 and the area including the side surface on the side of the driver seat 111D and the surrounding area in front of the vehicle 101. An area Rc8 is set so as not to include the side surface on the side of the passenger seat 111P of the vehicle 101.

Accordingly, the transmission pattern (8) is mainly used to detect the portable device 12 existing near the driver seat door 112D and outside the vehicle 101.

In the transmission pattern (9), the large-intensity disturbing signal is transmitted from the antenna B. Therefore, the normal signal is transmitted to an area Rb9 similarly to the area Rb3 of the transmission pattern (3) in FIG. 3. The medium-intensity disturbing signal is transmitted from the antenna C. Therefore, the disturbing signal is transmitted to an area Rc9 similarly to the area Rc8 of the transmission pattern (8). The antenna A does not transmit the signal.

Accordingly, the transmission pattern (9) is used to detect the portable device 12 existing near the tailgate 117 or in the space in the left rear portion in the vehicle 101.

(Second modification of processing in the case that operating switch 31 of driver seat door 112D is pressed)

Figure 16:
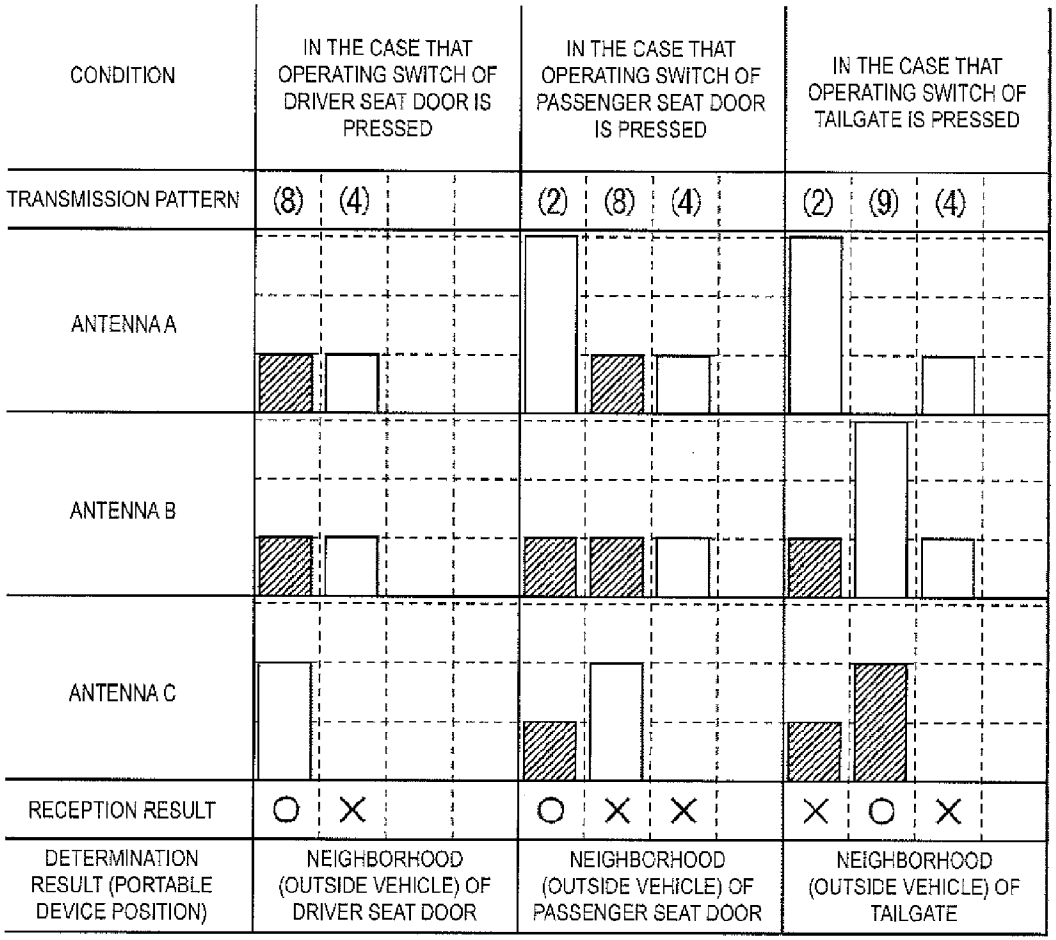
FIG. 16 is a view illustrating a second modification of the combination of the transmission patterns.

A second modification of the processing of the in-vehicle system 11 in the case that the operating switch 31 of the driver seat door 112D is pressed will be described below with reference to flowcharts in FIGS. 16 and 17. FIG. 16 illustrates an example of the combination of the transmission patterns similarly to FIG. 5 described above.

In Step S201, the in-vehicle system 11 transmits the signal of the transmission pattern (8). Specifically, the transmission controller 42 performs the control such that the small-intensity disturbing signal is transmitted from the antennas A and B and such that the medium-intensity normal signal is transmitted from the antenna C.

In Step S202, the position detector 44 determines whether the portable device 12 exists near the driver seat door 112D and outside the vehicle 101. Specifically, the position detector 44 determines that the portable device 12 exists near the driver seat door 112D and outside the vehicle 101 in the case that the position detector 44 receives the response signal of the signal transmission of the transmission pattern (8) from the portable device 12 through the receiving antenna 24 and the receiving part 43, and in the case that the position detector 44 successfully authenticates the authentication information included in the response signal. Then the processing goes to Step S203.

In Step S203, similarly to the processing in Step S3 of FIG. 6, the signal of the transmission pattern (4) is transmitted.

In Step S204, similarly to the processing in Step S4 of FIG. 6, whether the portable device 12 exists in the vehicle is determined. When it is determined that the portable device 12 does not exist in the vehicle in Step S204, the processing goes to Step S205.

In Step S205, the entry operation of the driver seat 111D is performed similarly to the processing in Step S5 of FIG. 6. Then the processing is ended.

In this case, the range where the user performs the entry operation of the driver seat door 112D in the outside of the vehicle is set wider than that of the case in FIG. 6 or 13.

When it is determined that the portable device 12 exists in the vehicle in Step S204, the processing goes to Step S206.

In Step S202, the position detector 44 determines that the portable device 12 does not exist near the driver seat door 112D and outside the vehicle 101 in the case that the position detector 44 does not receive the response signal of the signal transmission of the transmission pattern (8), or in the case that the position detector 44 fails in the authentication while receiving the response signal. Then the processing goes to Step S206.

In Step S206, the entry operation of the driver seat 111D is not performed similarly to the processing in Step S6 of FIG. 6. Then the processing is ended.

Figure 17:
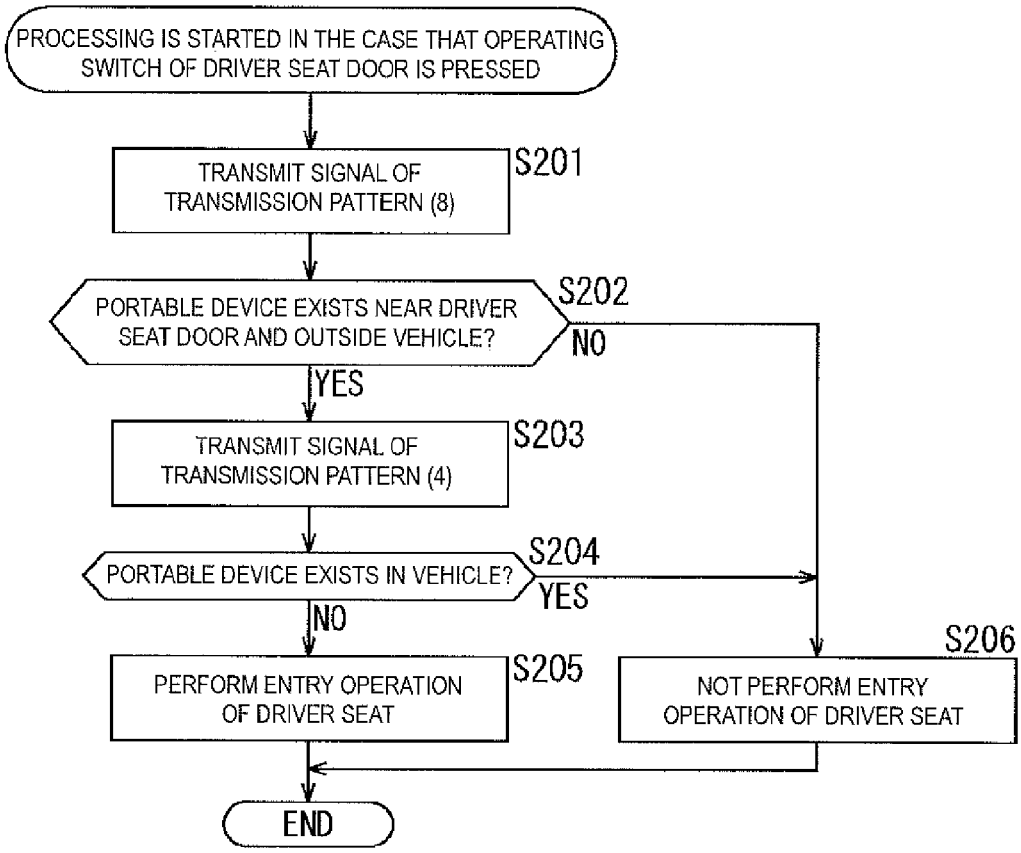
FIG. 17 is a flowchart illustrating a second modification of the processing when the operating switch of the driver seat door is pressed.

In the processing in FIG. 17, the signal transmission of the transmission pattern (4) and the corresponding determination processing can be eliminated as needed basis.

(Second modification of processing in the case that operating switch 32 of passenger seat door 112P is pressed)

A second modification of the processing of the in-vehicle system 11 in the case that the operating switches 32 of the passenger seat door 112P is pressed will be described below with reference to flowcharts in FIGS. 16 and 18.

In Step S221, similarly to the processing in Step S23 of FIG. 7, the signal of the transmission pattern (2) is transmitted.

In Step S222, similarly to the processing in Step S24 of FIG. 7, whether the portable device 12 exists near the passenger seat door 112P is determined. When it is determined that the portable device 12 exists near the passenger seat door 112P in Step S222, the processing goes to Step S223.

In Step S223, similarly to the processing in Step S201 of FIG. 17, the signal of the transmission pattern (8) is transmitted.

In Step S224, similarly to the processing in Step S202 of FIG. 17, whether the portable device 12 exists near the driver seat door 112D and outside the vehicle 101 is determined. When it is determined that the portable device 12 does not exist near the driver seat door 112D and outside the vehicle 101 in Step S224, the processing goes to Step S225.

In Step S225, similarly to the processing in Step S3 of FIG. 6, the signal of the transmission pattern (4) is transmitted.

In Step S226, similarly to the processing in Step S4 of FIG. 6, whether the portable device 12 exists in the vehicle is determined. When it is determined that the portable device 12 does not exist in the vehicle in Step S226, the processing goes to Step S227.

In Step S227, the entry operation of the passenger seat 111P is performed similarly to the processing in Step S27 of FIG. 7. Then the processing is ended.

When it is determined that the portable device 12 exists in the vehicle in Step S226, the processing goes to Step S228.

When it is determined that the portable device 12 exists near the driver seat door 112D and outside the vehicle 101 in Step S224, the processing goes to Step S228.

When it is determined that the portable device 12 does not exist near the passenger seat door 112P in Step S222, the processing goes to Step S228.

In Step S228, the entry operation of the passenger seat 111P is not performed similarly to the processing in Step S28 of FIG. 7. Then the processing is ended.

Figure 18:
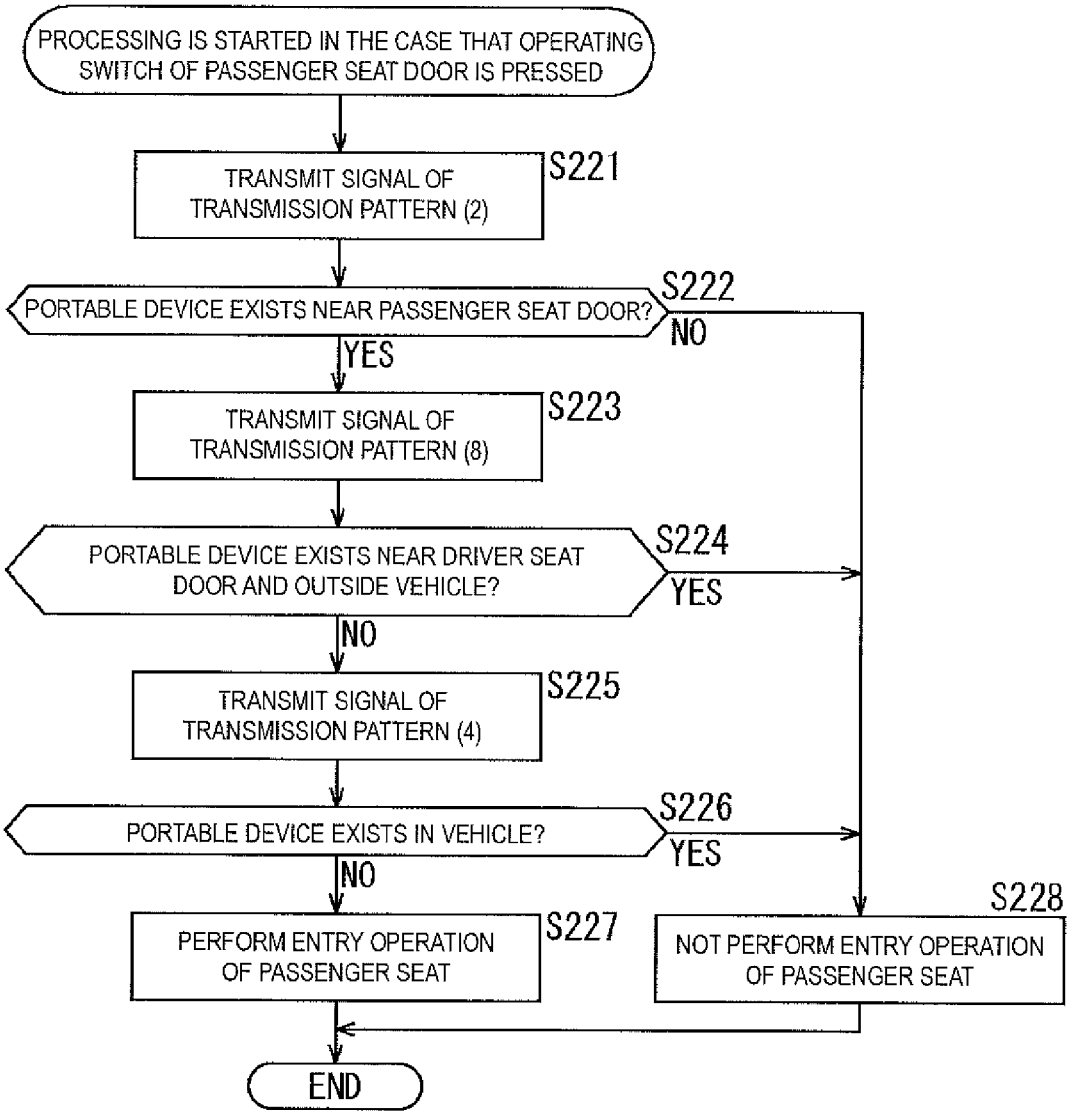
FIG. 18 is a flowchart illustrating a second modification of the processing when the operating switch of the passenger seat door is pressed.

In the processing in FIG. 18, the signal transmission of the transmission pattern (8) and the corresponding determination processing can be eliminated as needed basis.

(Modification of processing in the case that operating switch 33 of tailgate 117 is pressed)

A modification of the processing of the in-vehicle system 11 in the case that the operating switch 33 of the tailgate 117 is pressed will be described with reference to FIGS. 16 and 19.

In Step S241, similarly to the processing in Step S23 of FIG. 7, the signal of the transmission pattern (2) is transmitted.

In Step S242, similarly to the processing in Step S24 of FIG. 7, whether the portable device 12 exists near the passenger seat door 112P is determined. When it is determined that the portable device 12 does not exist near the passenger seat door 112P in Step S242, the processing goes to Step S243.

In Step S243, the in-vehicle system 11 transmits the signal of the transmission pattern (9). Specifically, the transmission controller 42 performs the control such that the large-intensity normal signal is transmitted from the antenna B, such that the medium-intensity disturbing signal is transmitted from the antenna C and such that the signal is not transmitted from the antenna A. The transmission controller 42 notifies the position detector 44 that the signal of the transmission pattern (9) is transmitted.

In Step S244, the position detector 44 determines whether the portable device 12 exists near the tailgate 117 or in the space in the left rear portion in the vehicle 101. Specifically, the position detector 44 determines that the portable device 12 exists near the tailgate 117 or in the space in the left rear portion in the vehicle 101 in the case that the position detector 44 receives the response signal of the signal transmission of the transmission pattern (9) from the portable device 12 through the receiving antenna 24 and the receiving part 43, and in the case that the position detector 44 successfully authenticates the authentication information included in the response signal. Then the processing goes to Step S245.

In Step S245, similarly to the processing in Step S3 of FIG. 6, the signal of the transmission pattern (4) is transmitted.

In Step S246, similarly to the processing in Step S4 of FIG. 6, whether the portable device 12 exists in the vehicle is determined. When it is determined that the portable device 12 does not exist in the vehicle in Step S246, the processing goes to Step S247.

In Step S247, the entry operation of the tailgate 117 is performed similarly to the processing in Step S45 of FIG. 8. Then the processing is ended.

When it is determined that the portable device 12 exists in the vehicle in Step S246, the processing goes to Step S248.

In Step S244, the position detector 44 determines that the portable device 12 does not exist near the tailgate 117 and in the space in the left rear portion in the vehicle 101 in the case that the position detector 44 does not receive the response signal of the signal transmission of the transmission pattern (9), or in the case that the position detector 44 fails in the authentication while receiving the response signal. Then the processing goes to Step S248.

When it is determined that the portable device 12 exists near the passenger seat door 112P in Step S242, the processing goes to Step S248.

In Step S248, the entry operation of the tailgate 117 is not performed similarly to the processing in Step S46 of FIG. 8. Then the processing is ended.

Figure 19:
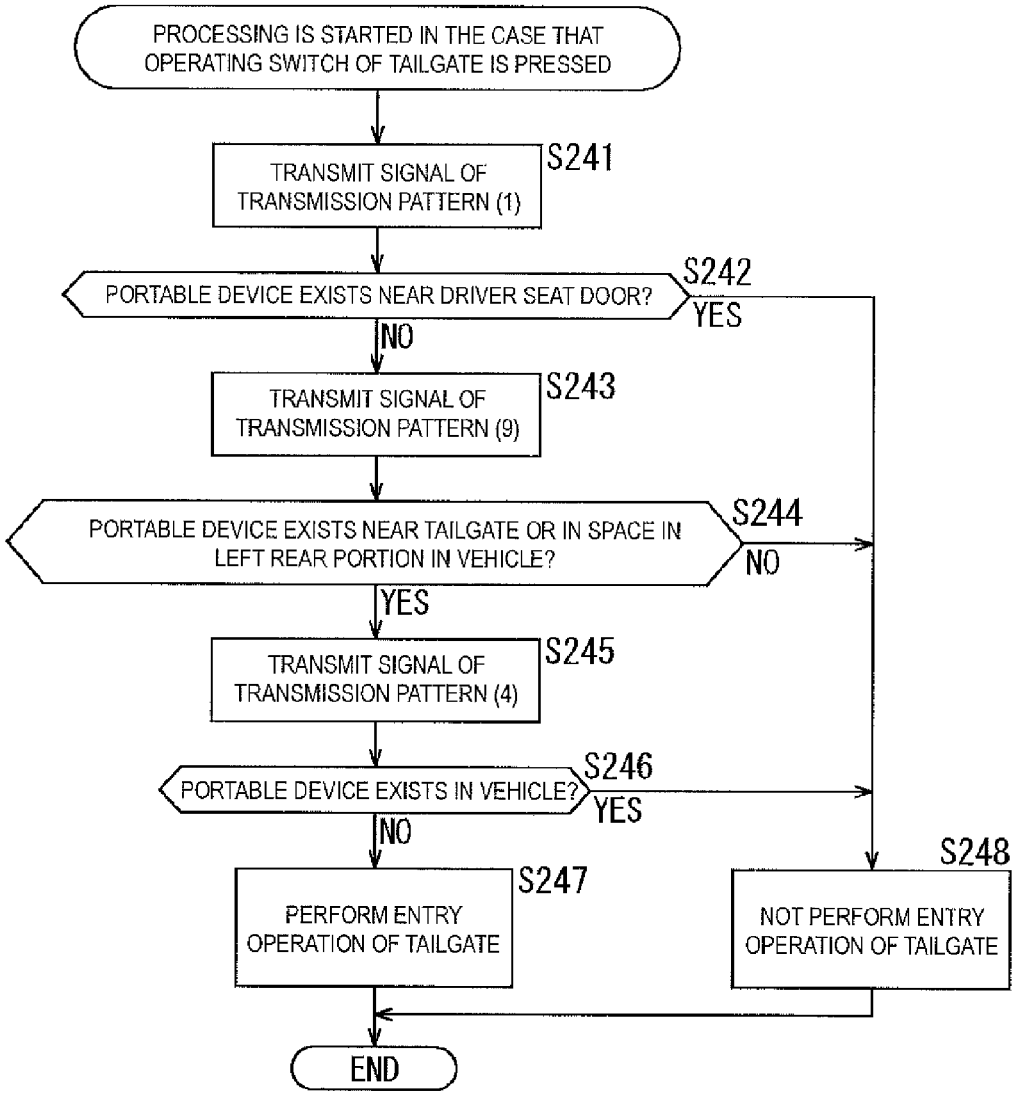
FIG. 19 is a flowchart illustrating a modification of the processing when the operating switch of the tailgate is pressed.

In the processing in FIG. 19, the signal transmission of the transmission pattern (4) and the corresponding determination processing can be eliminated as needed basis.

(Modification of transmission pattern performing sequence)

A transmission pattern performing sequence can arbitrarily be changed in the combinations of the transmission patterns of the cases in FIGS. 5, 6, 12, and 16. For example, in the case that the operating switch 31 of the driver seat door 112D in FIG. 5 is pressed, the signal is transmitted in the order of the transmission pattern (4) and the transmission pattern (1).

(Modification of transmission intensity level of normal signal or disturbing signal)

In the above description, by way of example, the transmission intensities of the normal signal and the disturbing signal are classified into the three stages of large, medium, and small or four stages of large, medium, small, and no transmission. Alternatively, the transmission intensities of the normal signal and the disturbing signal is classified into two stages or at least five stages.

In the above description, in the case that the signal having the identical intensity is transmitted from the identical transmitting antenna 23 between different transmission patterns, it is not always necessary to transmit the signal having the strictly identical intensity. That is, the transmission intensity may finely be adjusted in each transmission pattern according to conditions such as the kind of the transmitted signal, a relationship with the signal transmitted another transmitting antenna 23 and the use application.

In the above description, by way of example, the identical small-intensity signal is transmitted from the antenna C in the transmission pattern (1) and the transmission pattern (2). In this case, the intensity of the transmitting signal of the antenna C may be varied between the transmission pattern (1) and the transmission pattern (2) according to conditions such as a difference between the normal signal and the disturbing signal, the kind or intensity of the signal transmitted from the antennas A and B, and the position at which the portable device 12 is detected.

(Modification of disposition of transmitting antenna)

For example, the transmitting antenna 23*c* (antenna C) may be disposed in the side surface on not the side of the driver seat 111D but the side of the passenger seat 111P of the vehicle 101. More specifically, for example, the transmitting antenna 23*c* may be disposed in the door handle 113P located near the passenger seat 111P in the side surface of the vehicle 101, a side mirrors 114P, or a pillar 115P such that the directivity of the transmitting antenna 23*c* is oriented in the front-back direction of the vehicle 101.

In this case, the combination of the transmission patterns performed in the case that the operating switch 31 of the driver seat door 112D is pressed and the combination of the transmission patterns performed in the case that the operating switch 32 of the passenger seat door 112P is pressed are reversed.

Figure 20:
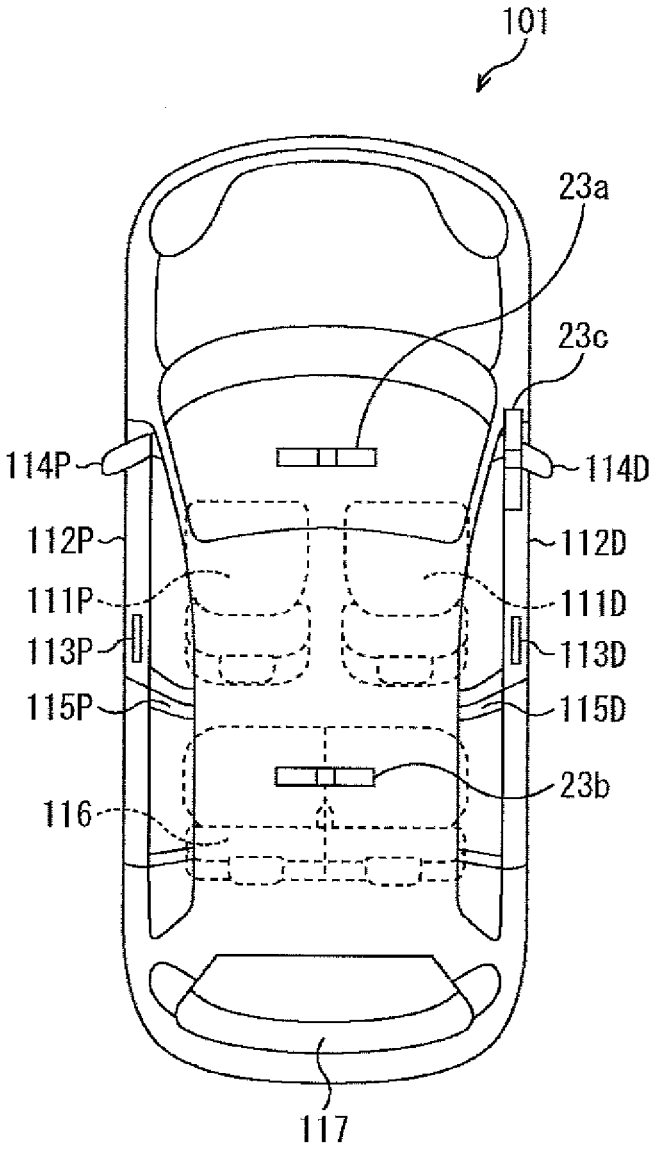
FIG. 20 is a schematic diagram illustrating a first modification of the disposition of the transmitting antennas.

As illustrated in FIG. 20, the directivity of the transmitting antenna 23*b* (Antenna B) may be oriented in the crosswise direction of the vehicle 101.

Figure 21:
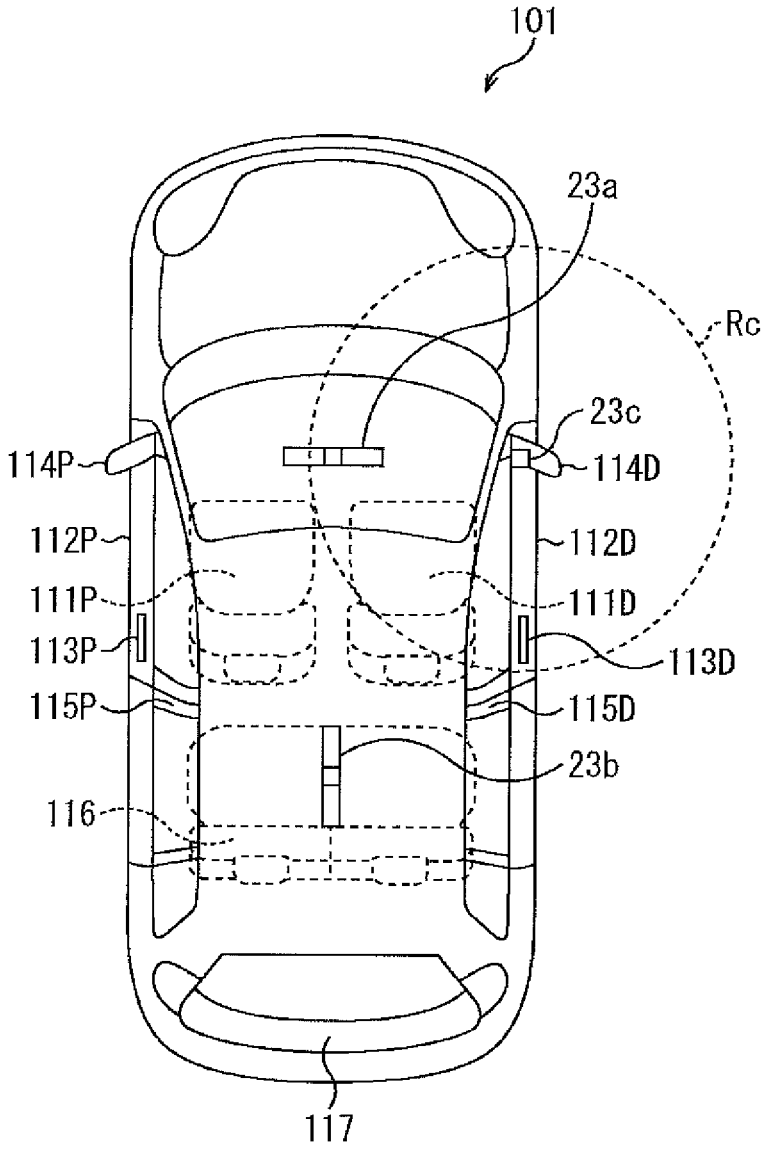
FIG. 21 is a schematic diagram illustrating a second modification of the dispositions of the transmitting antennas.

As illustrated in FIG. 21, the directivity of the transmitting antenna 23*c* (Antenna C) may be oriented in the up-and-down direction (height direction) of the vehicle 101. In this case, a horizontal transmission area Arc of the signal from the transmitting antenna 23*c* can be set to not the elliptical shape but the shape close to the precise circle with the transmitting antenna 23*c* as the center. As described above, actually the transmission area Arc does not necessarily become the precise circle due to the influence of the metallic portion of the vehicle body, (Other Modifications)

For example, in the case that security is not required, the response signal authentication processing may be eliminated.

One or more embodiments of the present invention can be applied to the case, in which the position of the portable device 12 is detected or the vehicle 101 is controlled based on the intensity of the response signal, in addition to the existence or non-existence of the response signal.

Alternatively, the position detector 44 is eliminated (the processing of detecting the position of the portable device 12 is eliminated), and the vehicle controller 41 may control the vehicle 101 based only on the reception result of the response signal from the portable device 12 in each transmission pattern using the predetermined determination table.

For example, a "vehicle operation" is set in FIG. 5 instead of the "determination result (portable device position) ", the set operation of the vehicle 101 may be performed when the reception result of the response signal meets the expectation in each case and the operation of the vehicle 101 may not be performed when that the reception result of the response signal does not meet the expectation.

For example, in the case that the operating switch 31 of the driver seat door 112D is pressed in FIG. 5, the entry operation of the driver seat door 112D may be performed when the response signal is successfully received in the transmission pattern (1) without detecting (determining) the position of the portable device 12 and when the failure of the reception of response signal is made in the transmission pattern (4), and the entry operation of the driver seat door 112D may not be performed in other cases.

In the above description, by way of example, the vehicle 101 is operated using the portable device 12. Additionally, one or more embodiments of the present invention can be applied to the case that the portable device 12 is used in the operation except the operation of the vehicle 101. For example, one or more embodiments of the present invention can be applied to the case that the information (such as map information, running information on the vehicle, and breakdown information) is transmitted and received between the portable device 12 and the vehicle 101 according to the position of the portable device 12.

In the above description, by way of example, the tailgate 117 is locked and unlocked using the portable device 12. Additionally, one or more embodiments of the present invention can be applied to the case that the opening and closing body (such as the trunk lid) at in the rear portion of the vehicle except the tailgate 117 is locked and unlocked.

Even in the transmission area of the disturbing signal, the portable device 12 can receive the normal signal at the position at which the intensity of the normal signal is sufficiently stronger than that of the disturbing signal. Accordingly, for example, the portable device 12 can be detected near the driver seat door 112D in the case that the intensity of the normal signal from the antenna C is set near the driver seat door 112D so as to be sufficiently stronger than the intensity of the disturbing signal from the antenna A in the transmission pattern (5) in FIG. 4. Therefore, the portable device 12 existing in the surrounding area of the vehicle 101 and the area except the passenger seat door 112P and the neighborhood of the tailgate 117 can be detected by the transmission pattern (5).

The above sequence of pieces of processing can be performed by either hardware or software. In the case that the sequence of pieces of processing can be performed by the software, a program constituting the software is installed on a computer. At this point, examples of the computer include a computer incorporated in a dedicated hardware and a general-purpose computer in which various functions can be executed by installing various programs.

For example, the program executed by the computer can be provided while recording in a removable medium that is a package medium. The program can be provided through a wired or wireless transmission medium such as a local area network, CAN, the Internet, and digital satellite broadcasting.

The program executed by the computer may be a program in which the processing is performed in time series along the sequence described in the specification, a program in which the pieces of processing are concurrently performed, or a program in which the processing is performed in such necessary timing that a call is performed.

In the specification, the system means a set of plural structural elements (such as a device and a module (component)) irrespective of the fact that all the structural elements are provided in the identical casing. Accordingly, both plural devices that are separately accommodated in the casings and connected to each other through a network and one device in which plural modules are accommodated in one casing is the system.

The present invention is not limited to the above-described embodiments and the modifications and various changes can be made without departing from the scope of the present invention.

Not only each step in the flowcharts can be performed by one device, but also the step can be performed while shared by plural devices.

In the case that one step includes plural pieces of processing, not only the pieces of processing included in the one step can be performed by one device, but also the pieces of processing can be performed while shared by plural devices.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An in-vehicle system comprising:

a first transmitting antenna that is disposed in a substantial center in a front portion inside a vehicle;

a second transmitting antenna that is disposed in the substantial center in a rear portion inside the vehicle;

a third transmitting antenna that is disposed in a side surface near a driver seat or a passenger seat of the vehicle;

a transmission controller that controls transmission of signals from the first to third transmitting antennas, and controls existence or non-existence of the transmission of a first signal and a second signal from the first to third transmitting antennas, the second signal disturbing reception of the first signal, and a transmission pattern that is a pattern of transmission intensity;

a receiving antenna that receives a response signal, the response signal being transmitted from a portable device receiving the first signal transmitted from the first to third transmitting antennas; and a position detector that detects a position of the portable device based on a reception result of the response signal from the portable device in each transmission pattern when at least two transmission patterns are combined.

2. The in-vehicle system according to claim 1, wherein the first transmitting antenna is disposed such that directivity of the first transmitting antenna is oriented in a crosswise direction of the vehicle.

3. The in-vehicle system according to claim 1, wherein the second transmitting antenna is disposed such that the directivity of the second transmitting antenna is oriented in a front-back direction of the vehicle.

4. The in-vehicle system according to claim 1, wherein the second transmitting antenna is disposed such that the directivity of the second transmitting antenna is oriented in the crosswise direction of the vehicle.

5. The in-vehicle system according to claim 1, wherein the third transmitting antenna is disposed such that the directivity of the third transmitting antenna is oriented in the front-back direction of the vehicle.

6. The in-vehicle system according to claim 1, wherein the third transmitting antenna is disposed such that the directivity of the third transmitting antenna is oriented in an up-and-down direction of the vehicle.

7. The in-vehicle system according to claim 1, wherein the third transmitting antenna is disposed in the side surface on a side of the driver seat of the vehicle.

8. The in-vehicle system according to claim 7, wherein the third transmitting antenna is disposed in a side mirror or a door handle on the side of the driver seat.

9. The in-vehicle system according to claim 1, further comprising a vehicle controller that controls the vehicle based on the detected position of the portable device.

10. The in-vehicle system according to claim 9, wherein the vehicle controller controls locking or unlocking of a door of the driver seat, a door of the passenger seat, or the opening and closing body in the rear portion of the vehicle based on whether the portable device exists near the door of the driver seat, the door of the passenger seat, or the opening and closing body outside the vehicle.

11. The in-vehicle system according to claim 9, wherein the vehicle controller controls starting of the vehicle based on whether the portable device exists in the vehicle.

12. The in-vehicle system according to claim 1, wherein the position detector detects the portable device which exists:

in a neighborhood of a driver seat door in an outside of the vehicle;

in a neighborhood of a passenger seat door in the outside of the vehicle;

in a neighborhood of an opening and closing body in a rear portion of the vehicle and in the outside of the vehicle;

in the vehicle; and in a surrounding area of the vehicle except the neighborhood of the driver seat door, the neighborhood of the passenger seat door, and the neighborhood of the opening and closing body.

13. An in-vehicle system comprising:

a first transmitting antenna that is disposed in a substantial center in a front portion inside a vehicle;

a second transmitting antenna that is disposed in the substantial center in a rear portion inside the vehicle;

a third transmitting antenna that is disposed in a side surface near a driver seat or a passenger seat of the vehicle;

a transmission controller that controls transmission of a first signal or a second signal from the first to third transmitting antennas, the second signal disturbing reception of the first signal;

a receiving antenna that receives a response signal, the response signal being transmitted from a portable device receiving the first signal transmitted from the first to third transmitting antennas; and a position detector that detects a position of the portable device based on a transmission content of the signal from the first to third transmitting antennas and a reception result of the response signal from the portable device, wherein the third transmitting antenna is disposed in the side surface on a side of the driver seat of the vehicle, wherein the transmission controller performs control such that the first signal or the second signal is transmitted from the first transmitting antenna to a first area including the driver seat and the passenger seat in the vehicle or a second area inside and outside the vehicle, the second area including a neighborhood of a door of the driver seat and a neighborhood of a door of the passenger seat, wherein the transmission controller performs control such that the first signal or the second signal is transmitted from the second transmitting antenna to a third area including a rear seat and a luggage room in the vehicle or a fourth area inside and outside the vehicle, wherein the fourth area including a neighborhood of an opening and closing body in the rear portion of the vehicle, and wherein the transmission controller performs control such that the first signal or the second signal is transmitted from the third transmitting antenna to a fifth area near the driver seat door inside and outside the vehicle.

14. The in-vehicle system according to claim 13, wherein the transmission controller further performs control such that the first signal or the second signal is transmitted from the third transmitting antenna to a sixth area including the whole vehicle and a surrounding area of the vehicle.

15. The in-vehicle system according to claim 13, wherein the transmission controller further performs control such that the first signal or the second signal is transmitted from the third transmitting antenna to a seventh area inside and outside the vehicle, and wherein the seventh area includes a neighborhood of the side surface on the side of the driver seat and not including the side surface on the side of the passenger seat.

16. An in-vehicle system comprising:

a first transmitting antenna that is disposed in a substantial center in a front portion inside a vehicle;

a second transmitting antenna that is disposed in the substantial center in a rear portion inside the vehicle;

a third transmitting antenna that is disposed in a side surface near a driver seat or a passenger seat of the vehicle;

a transmission controller that controls transmission of a signal from the first to third transmitting antennas, and controls existence or non-existence of transmission of a first signal and a second signal from the first to third transmitting antennas and a transmission pattern that is a pattern of transmission intensity, the second signal disturbing reception of the first signal;

a receiving antenna that receives a response signal, the response signal being transmitted from a portable device receiving the first signal transmitted from the first to third transmitting antennas; and a vehicle controller that controls the vehicle based on a reception result of the response signal from the portable device in each transmission pattern when at least two transmission patterns are combined.

* * * * *